US008182326B2

(12) United States Patent
Speer, II et al.

(10) Patent No.: US 8,182,326 B2
(45) Date of Patent: May 22, 2012

(54) OUTCOME BASED DISPLAY OF GAMING RESULTS

(75) Inventors: L. Donald Speer, II, San Diego, CA (US); W. Greg Shay, Las Vegas, NV (US); Kevin McIntosh, San Diego, CA (US); Donne Grable, San Diego, CA (US)

(73) Assignee: VCAT, LLC, San Diego, CA (US)

( * ) Notice: Subject to any disclaimer, the term of this patent is extended or adjusted under 35 U.S.C. 154(b) by 442 days.

(21) Appl. No.: 12/398,889

(22) Filed: Mar. 5, 2009

(65) Prior Publication Data

US 2010/0227662 A1 Sep. 9, 2010

(51) Int. Cl.
*A63F 9/24* (2006.01)

(52) U.S. Cl. ..... 463/16; 463/17; 463/20; 463/21; 463/31; 463/42; 273/138.1; 273/139

(58) Field of Classification Search ..... 438/10–13, 438/16–22, 31, 39, 40, 42, 43; 273/138.1, 273/139

See application file for complete search history.

(56) References Cited

U.S. PATENT DOCUMENTS

| | | | | |
|---|---|---|---|---|
| 4,527,798 | A | 7/1985 | Siekierski et al. | |
| 4,531,187 | A | 7/1985 | Uhland | |
| 4,926,327 | A | 5/1990 | Sidley | |
| 5,127,651 | A | 7/1992 | Okada | |
| 5,855,515 | A | 1/1999 | Pease et al. | |
| 5,857,909 | A | 1/1999 | Rubin | |
| 6,217,447 | B1 | 4/2001 | Lofink et al. | |
| 6,227,970 | B1 | 5/2001 | Shimizu et al. | |
| 6,229,170 | B1 * | 5/2001 | Sakao | 257/296 |
| 6,383,073 | B1 | 5/2002 | Nagano | |
| 6,890,254 | B2 | 5/2005 | Kaminkow | |
| 6,966,834 | B1 | 11/2005 | Johnson | |
| 7,029,394 | B2 | 4/2006 | Leen et al. | |
| 7,066,815 | B2 | 6/2006 | Walker et al. | |
| 7,134,959 | B2 | 11/2006 | Penrice | |
| 7,427,236 | B2 | 9/2008 | Kaminkow et al. | |
| 2003/0195025 | A1 | 10/2003 | Hill | |
| 2004/0053662 | A1 | 3/2004 | Pacey | |
| 2004/0078208 | A1 | 4/2004 | Burwell | |
| 2004/0166932 | A1 | 8/2004 | Lam et al. | |
| 2004/0185931 | A1 | 9/2004 | Lowell et al. | |
| 2004/0261102 | A1 | 12/2004 | Itoh | |
| 2005/0043089 | A1 * | 2/2005 | Nguyen et al. | 463/29 |
| 2005/0125244 | A1 | 6/2005 | Schneider | |
| 2005/0143169 | A1 * | 6/2005 | Nguyen et al. | 463/25 |
| 2006/0066044 | A1 | 3/2006 | Dabosh | |

(Continued)

FOREIGN PATENT DOCUMENTS

EA 3661 B1 8/2003

(Continued)

*Primary Examiner* — Hsien Ming Lee
(74) *Attorney, Agent, or Firm* — Stolowitz Ford Cowger LLP

(57) ABSTRACT

Embodiments of the present invention are directed to gaming devices and gaming systems having an outcome based display of summarized past gaming results and a method of processing and displaying the past gaming results. In one example, a gaming device may record game information corresponding to the gaming event on the device and a memory and store this recorded information in a memory. The recorded information may be processed by the gaming device or another device connected to the gaming device to generate a summarized display of the recorded information to depict to a current gaming player or prospective gaming player.

24 Claims, 22 Drawing Sheets

U.S. PATENT DOCUMENTS

| | | | | |
|---|---|---|---|---|
| 2006/0079314 | A1 * | 4/2006 | Walker et al. | 463/20 |
| 2007/0111793 | A1 | 5/2007 | Miller et al. | |
| 2007/0293295 | A1 | 12/2007 | Kim | |
| 2008/0045288 | A1 | 2/2008 | Moshal et al. | |
| 2008/0058068 | A1 | 3/2008 | Bennett et al. | |
| 2008/0070702 | A1 * | 3/2008 | Kaminkow et al. | 463/46 |
| 2008/0076506 | A1 | 3/2008 | Nguyen et al. | |
| 2008/0113715 | A1 | 5/2008 | Beadell et al. | |
| 2008/0113782 | A2 | 5/2008 | Moshal | |
| 2008/0139286 | A1 | 6/2008 | Post | |
| 2008/0146309 | A1 | 6/2008 | Bennett | |
| 2008/0146324 | A1 | 6/2008 | Anderson | |
| 2008/0153562 | A1 | 6/2008 | Ohara et al. | |
| 2008/0153576 | A1 | 6/2008 | Tempest et al. | |
| 2008/0153585 | A1 | 6/2008 | Packes et al. | |
| 2008/0153589 | A1 | 6/2008 | Baray et al. | |
| 2008/0167118 | A1 | 7/2008 | Kroeckel et al. | |
| 2008/0167130 | A1 | 7/2008 | Kroeckel et al. | |
| 2008/0268935 | A1 | 10/2008 | Acres | |
| 2009/0062001 | A1 | 3/2009 | LeMay et al. | |

FOREIGN PATENT DOCUMENTS

| | | | |
|---|---|---|---|
| EP | 0 534 718 | A2 | 3/1993 |
| GB | 2 354 179 | A | 3/2001 |
| JP | 03-234274 | A | 10/1991 |
| JP | 11-272931 | | 10/1999 |
| JP | 11-333088 | A | 12/1999 |
| JP | 2000-350856 | A | 12/2000 |
| JP | 2007-275250 | A | 10/2007 |
| JP | 2008-142515 | A | 1/2008 |
| JP | 2008-229081 | A | 10/2008 |

* cited by examiner

OUTCOME BASED DISPLAY OF GAMING RESULTS

RELATED APPLICATIONS

Commonly assigned U.S. Patent Applications:

No. 12/398,911, to L. Donald Speer II et al., filed concurrently herewith, for RANDOM GENERATED DISPLAY ASSOCIATED WITH GAMING DEVICE.

FIELD OF THE INVENTION

This disclosure relates generally to gaming devices, and more particularly to gaming devices having an outcome based display of summarized past gaming results and a method of processing and displaying the past gaming results.

BACKGROUND

With games of chance, gaming players often seek out certain games (including but not limited to slot machines, electronic table games, live action table games, internet games, lotteries, etc.) or game configurations (including but not limited to player positions, dealers, game devices such as card shoes, etc.) or change their behavior based on actual or perceived patterns or trends the players believe they see related to a game, a game configuration, or a player. The patterns or trends that are likely to influence their behavior can be based on game or player outcomes and can be applicable to the game type, gaming device, game location, player position, game configuration, etc. These patterns or trends can influence player behavior in many ways, including a decision to play or not, the game type and/or location of the game they choose to play, the wager amount, etc. Behavior influence is often times attributable to the player's belief that future outcomes are, or will be, more predictable based on actual or perceived patterns or trends derived from past outcomes.

Currently, players can experience their own outcomes, can witness them by observing the outcomes of others, and in some instances can view a small range of individual game outcomes displayed to all (i.e., displays of roulette outcomes or baccarat outcomes). However, they are not given an opportunity to see a large range of consolidated outcomes presented in a manner that shows players actual or perceived patterns or trends they are seeking that may influence their various playing decisions.

The patterns or trends they may be seeking can vary widely. Often times the patterns or trends they are seeking are simple. For example, a player might try to determine what games or game configurations have been good for the player, or alternatively bad for the player and good for the "house." The range of outcomes they consider when making this determination can also vary widely. The player might be interested in knowing this for: past outcomes over a very short to a very long period of time; for a small to wide number of past outcomes; for a specific session or sessions; for a specific player; for a specific position; for specific configurations, etc.

Players may also be seeking out patterns or trends that make them believe the "law of averages" will occur or that show them when a game has been generating outcomes that deviate widely from statistical averages. For example, if a machine has not paid out a large winning hand for a long period of time it might be "due" to pay in their minds. A player might believe that when past outcomes have been consistently performing a certain way future outcomes are more (or less) likely to continue in that manner and will act accordingly. For example, if there have been 5 "banker" wins in a row, they might believe that "player" is due to hit.

Players may also simply believe that a game or configuration is simply lucky or not lucky based on actual or perceived patterns or trends of past outcomes and will act accordingly. For example, a player might walk up to a blackjack table and ask how the table has been, the other players might comment that the dealer has been hot (or the last shoe was cold) and that player might move on to a new table.

Thus, it is likely that player behavior and the decisions they make are, and can be further influenced by, patterns or trends the players believe they see and that the player experience will be enhanced or changed by creating a method and system of consolidating and presenting the outcome patterns or trends to players as part of, or in conjunction with, the games they seek to play.

DETAILED DESCRIPTION

As discussed above, a method and system for recording and processing gaming metrics, such as game and/or player outcomes, and displaying the processed metrics in one or more ways is desirable to heighten the gaming interest of players or potential players. As will be discussed in detail below, displayed game information may be presented on any display device, including but not limited to the game screen or on any screen or panel on a gaming device, in a secondary display device attached or detached from the gaming device, or any other display applications used on or with a gaming device or group of gaming devices. As opposed to displaying only recent gaming outcomes of a gaming device, embodiments of this concept present summarized game information that may include trend or pattern indications, actual or perceived. Some of these embodiments further allow a player to manipulate the past game data to access specific subsets of the game information or to change the type of display of the game information.

This system may be used for game outcomes and player outcomes from all types of electronic gaming devices, such as slot machines and video poker machines, as well as being used for table games (live action or automated table games), lotteries, internet gaming systems, mobile gaming devices, etc. In addition the recorded game outcomes may include any type of outcome, such as final game results and intermediate game results. These results may include, among others: jackpots, royal flushes, 4-of-a-kinds, 4 aces, blackjacks, symbol occurrences, player/banker/natural/tie outcomes, reel symbol positions, payouts above certain credit or dollar amount, wins or hits on secondary or bonus games or features, etc. Player outcomes may include, among others: wins/losses/ties, winning percentages, payout percentages, wager outcomes (actual win or loss), etc.

Figure 1A:
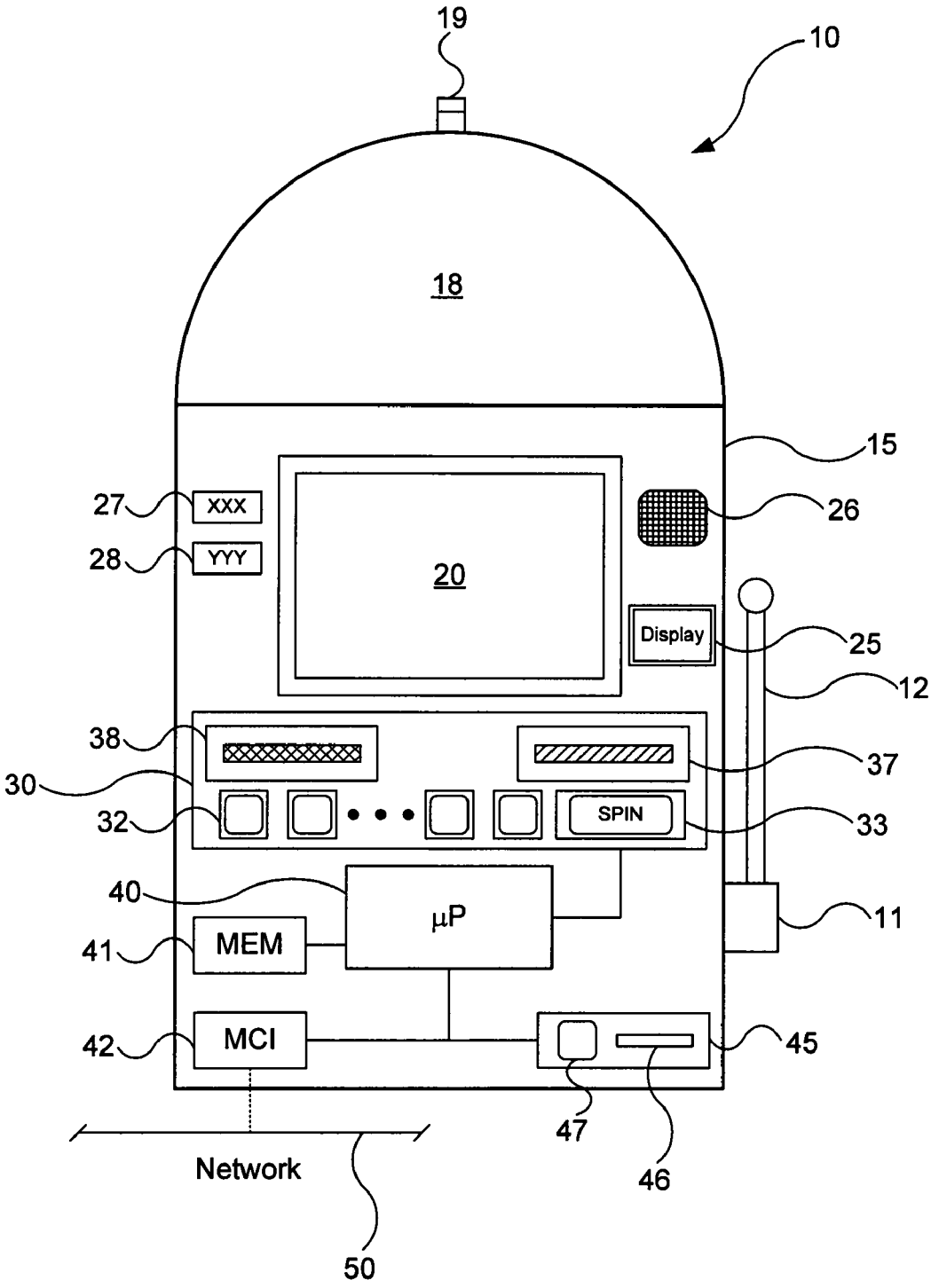
FIG. 1A is a functional block diagram that illustrates a gaming device according to embodiments of the invention.
Figure 1B:
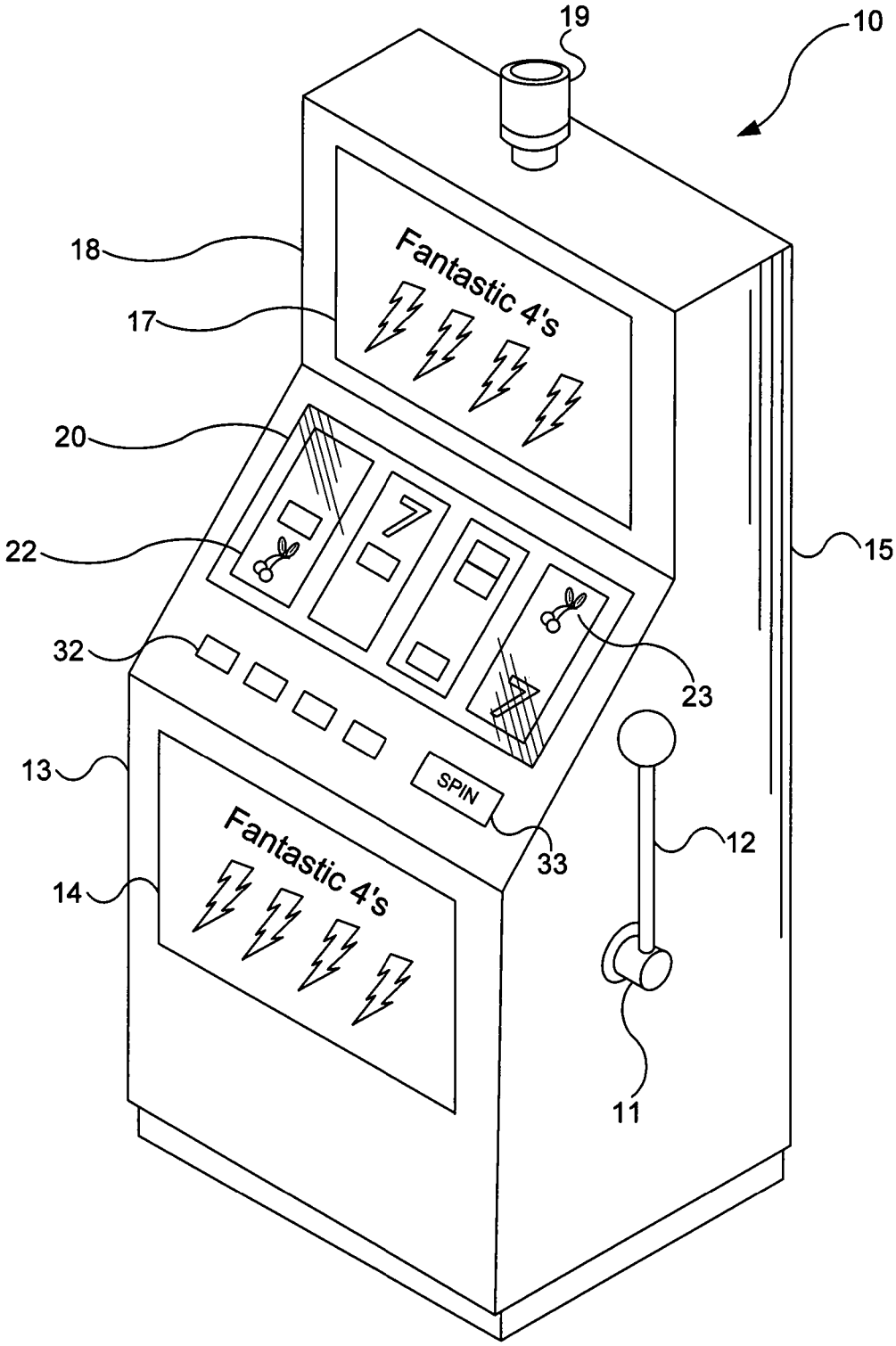
FIG. 1B is an isometric view of the gaming device illustrated in FIG. 1A.

FIGS. 1A and 1B illustrate example gaming devices according to embodiments of the invention.

Referring to FIGS. 1A and 1B, a gaming device 10 is an electronic gaming machine. Although an electronic gaming machine or "slot" machine is illustrated, various other types of devices may be used to wager monetarily based credits on a game of chance in accordance with principles of the invention. The term "electronic gaming device" is meant to include various devices such as electromechanical spinning-reel type slot machines, video slot machines, and video poker machines, for instance. Other gaming devices may include computer-based gaming machines, wireless gaming devices, multi-player gaming stations, modified personal electronic gaming devices (such as cell phones), personal computers, server-based gaming terminals, lottery devices, and other similar devices. Although embodiments of the invention will work with all of the gaming types mentioned, for ease of illustration the present embodiments will be described in reference to the electronic gaming machine 10 shown in FIGS. 1A and 1B.

The gaming device 10 includes a cabinet 15 housing components to operate the gaming device 10. The cabinet 15 may include a gaming display 20, a base portion 13, a top box 18, and a player interface panel 30. The gaming display 20 may include mechanical spinning reels (FIG. 2A), a video display (FIGS. 2B and 2C), or a combination of both spinning reels and a video display (not shown). The gaming cabinet 15 may also include a credit meter 27 and a coin-in or bet meter 28. The credit meter 27 may indicate the total number of credits remaining on the gaming device 10 that are eligible to be wagered. In some embodiments, the credit meter 27 may reflect a monetary unit, such as dollars. However, it is often preferable to have the credit meter 27 reflect a number of 'credits,' rather than a monetary unit. The bet meter 28 may indicate the amount of credits to be wagered on a particular game. Thus, for each game, the player transfers the amount that he or she wants to wager from the credit meter 27 to the bet meter 28. In some embodiments, various other meters may be present, such as meters reflecting amounts won, amounts paid, or the like. In embodiments where the gaming display 20 is a video monitor, the information indicated on the credit meters may be shown on the gaming display itself 20 (FIG. 2B).

The base portion 13 may include a lighted panel 14, a coin return (not shown), and a gaming handle 12 operable on a partially rotating pivot joint 11. The game handle 12 is traditionally included on mechanical spinning-reel games, where the handle may be pulled toward a player to initiate the spinning of reels 22 after placement of a wager. The top box 18 may include a lighted panel 17, a video display (such as an LCD monitor), a mechanical bonus device (not shown), and a candle light indicator 19. The player interface panel 30 may include various devices so that a player can interact with the gaming device 10.

The player interface panel 30 may include one or more game buttons 32 that can be actuated by the player to cause the gaming device 10 to perform a specific action. For example, some of the game buttons 32 may cause the gaming device 10 to bet a credit to be wagered during the next game, change the number of lines being played on a multi-line game, cash out the credits remaining on the gaming device (as indicated on the credit meter 27), or request assistance from casino personnel, such as by lighting the candle 19. In addition, the player interface panel 30 may include one or more game actuating buttons 33. The game actuating buttons 33 may initiate a game with a pre-specified amount of credits. On some gaming devices 10 a "Max Bet" game actuating button 33 may be included that places the maximum credit wager on a game and initiates the game. The player interface panel 30 may further include a bill acceptor 37 and a ticket printer 38. The bill acceptor 37 may accept and validate paper money or previously printed tickets with a credit balance. The ticket printer 38 may print out tickets reflecting the balance of the credits that remain on the gaming device 10 when a player cashes out by pressing one of the game buttons 32 programmed to cause a 'cashout.' These tickets may be inserted into other gaming machines or redeemed at a cashier station or kiosk for cash.

The gaming device 10 may also include one or more speakers 26 to transmit auditory information or sounds to the player. The auditory information may include specific sounds associated with particular events that occur during game play on the gaming device 10. For example, a particularly festive sound may be played during a large win or when a bonus is triggered. The speakers 26 may also transmit "attract" sounds to entice nearby players when the game is not currently being played.

The gaming device 10 may further include a secondary display 25. This secondary display 25 may be a vacuum fluorescent display (VFD), a liquid crystal display (LCD), a cathode ray tube (CRT), a plasma screen, or the like. The secondary display 25 may show any combination of primary game information and ancillary information to the player. For example, the secondary display 25 may show player tracking information, secondary bonus information, advertisements, or player selectable game options.

The gaming device 10 may include a separate information window (not shown) dedicated to supplying any combination of information related to primary game play, secondary bonus information, player tracking information, secondary bonus information, advertisements or player selectable game options. This window may be fixed in size and location or may have its size and location vary temporally as communication needs change. One example of such a resizable window is International Game Technology's "service window." Another example is Las Vegas Gaming Incorporated's retrofit technology which allows information to be placed over areas of the game or the secondary display screen at various times and in various situations.

The gaming device 10 includes a microprocessor 40 that controls operation of the gaming device 10. If the gaming device 10 is a standalone gaming device, the microprocessor 40 may control virtually all of the operations of the gaming devices and attached equipment, such as operating game logic stored in memory (not shown) as firmware, controlling the display 20 to represent the outcome of a game, communicating with the other peripheral devices (such as the bill acceptor 37), and orchestrating the lighting and sound emanating from the gaming device 10. In other embodiments where the gaming device 10 is coupled to a network 50, as described below, the microprocessor 40 may have different tasks depending on the setup and function of the gaming device. For example, the microprocessor 40 may be responsible for running the base game of the gaming device and executing instructions received over the network 50 from a bonus server or player tracking server. In a server-based gaming setup, the microprocessor 40 may act as a terminal to execute instructions from a remote server that is running game play on the gaming device.

The microprocessor 40 may be coupled to a machine communication interface (MCI) 42 that connects the gaming device 10 to a gaming network 50. The MCI 42 may be coupled to the microprocessor 40 through a serial connection, a parallel connection, an optical connection, or in some cases a wireless connection. The gaming device 10 may include memory 41 (MEM), such as a random access memory (RAM), coupled to the microprocessor 40 and which can be used to store gaming information, such as storing total coin-in statistics about a present or past gaming session, which can be communicated to a remote server or database through the MCI 42. The MCI 42 may also facilitate communication between the network 50 and the secondary display 25 or a player tracking unit 45 housed in the gaming cabinet 15.

The player tracking unit 45 may include an identification device 46 and one or more buttons 47 associated with the player tracking unit 45. The identification device 46 serves to identify a player, by, for example, reading a player-tracking device, such as a player tracking card that is issued by the casino to individual players who choose to have such a card. The identification device 46 may instead, or additionally, identify players through other methods. Player tracking systems using player tracking cards and card readers 46 are known in the art. Briefly summarizing such a system, a player registers with the casino prior to commencing gaming. The casino issues a unique player-tracking card to the player and opens a corresponding player account that is stored on a server or host computer, described below with reference to FIG. 3. The player account may include the player's name and mailing address and other information of interest to the casino in connection with marketing efforts. Prior to playing one of the gaming devices in the casino, the player inserts the player tracking card into the identification device 46 thus permitting the casino to track player activity, such as amounts wagered, credits won, and rate of play.

To induce the player to use the card and be an identified player, the casino may award each player points proportional to the money or credits wagered by the player. Players typically accrue points at a rate related to the amount wagered, although other factors may cause the casino to award the player various amounts. The points may be displayed on the secondary display 25 or using other methods. In conventional player tracking systems, the player may take his or her card to a special desk in the casino where a casino employee scans the card to determine how many accrued points are in the player's account. The player may redeem points for selected merchandise, meals in casino restaurants, or the like, which each have assigned point values. In some player tracking systems, the player may use the secondary display 25 to access their player tracking account, such as to check a total number of points, redeem points for various services, make changes to their account, or download promotional credits to the gaming device 10. In other embodiments, the identification device 46 may read other identifying cards (such as driver licenses, credit cards, etc.) to identify a player and match them to a corresponding player tracking account. Although FIG. 1A shows the player tracking unit 45 with a card reader as the identification device 46, other embodiments may include a player tracking unit 45 with a biometric scanner, PIN code acceptor, or other methods of identifying a player to pair the player with their player tracking account.

During typical play on a gaming device 10, a player plays a game by placing a wager and then initiating a gaming session. The player may initially insert monetary bills or previously printed tickets with a credit value into the bill acceptor 37. The player may also put coins into a coin acceptor (not shown) or a credit, debit or casino account card into a card reader/authorizer (not shown). One of skill in the art will readily see that this invention is useful with all gambling devices, regardless of the manner in which wager value-input is accomplished.

The credit meter 27 displays the numeric credit value of the money inserted dependent on the denomination of the gaming device 10. That is, if the gaming device 10 is a nickel slot machine and a $20 bill inserted into the bill acceptor 37, the credit meter will reflect 400 credits or one credit for each nickel of the inserted twenty dollars. For gaming devices 10 that support multiple denominations, the credit meter 27 will reflect the amount of credits relative to the denomination selected. Thus, in the above example, if a penny denomination is selected after the $20 is inserted the credit meter will change from 400 credits to 2000 credits.

A wager may be placed by pushing one or more of the game buttons 32, which may be reflected on the bet meter 28. That is, the player can generally depress a "bet one" button (one of the buttons on the player interface panel 30, such as 32), which transfers one credit from the credit meter 27 to the bet meter 28. Each time the button 32 is depressed an additional single credit transfers to the bet meter 28 up to a maximum bet that can be placed on a single play of the electronic gaming device 10. The gaming session may be initiated by pulling the gaming handle 12 or depressing the spin button 33. On some gaming devices 10, a "max bet" button (another one of the buttons 32 on the player interface panel 30) may be depressed to wager the maximum number of credits supported by the gaming device 10 and initiate a gaming session.

If the gaming session does not result in any winning combination, the process of placing a wager may be repeated by the player. Alternatively, the player may cash out any remaining credits on the credit meter 27 by depressing the "cash-out" button (another button 32 on the player interface panel 30), which causes the credits on the credit meter 27 to be paid out in the form of a ticket through the ticket printer 38, or may be paid out in the form of returning coins from a coin hopper (not shown) to a coin return tray.

If instead a winning combination (win) appears on the display 20, the award corresponding to the winning combination is immediately applied to the credit meter 27. For example, if the gaming device 10 is a slot machine, a winning combination of symbols 23 may land on a played payline on reels 22. If any bonus games are initiated, the gaming device 10 may enter into a bonus mode or simply award the player with a bonus amount of credits that are applied to the credit meter 27.

Figure 2A:
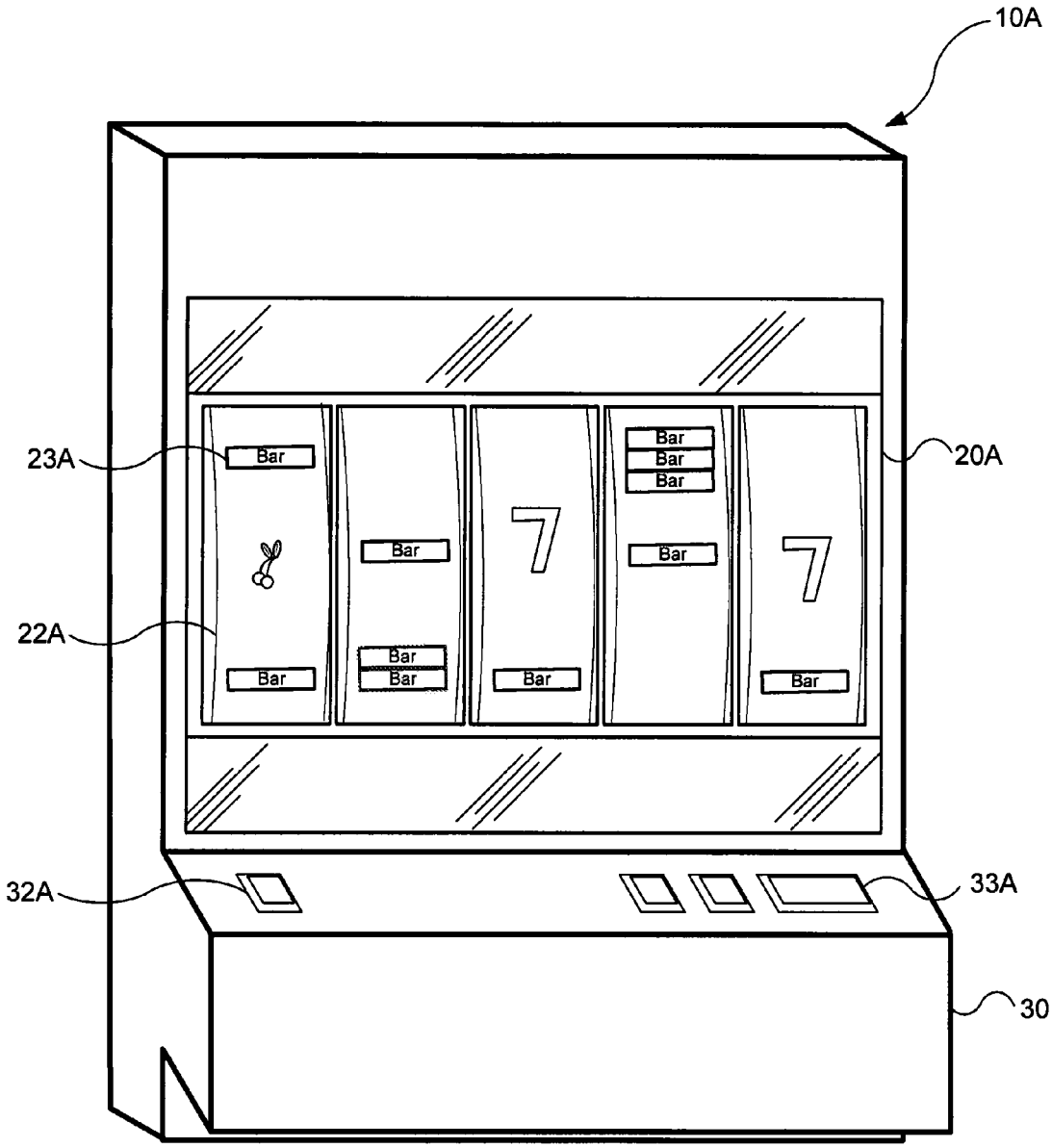
FIGS. 2A, 2B, 2C, and 2D are detail diagrams of exemplary types of gaming devices according to embodiments of the invention.
Figure 2B:
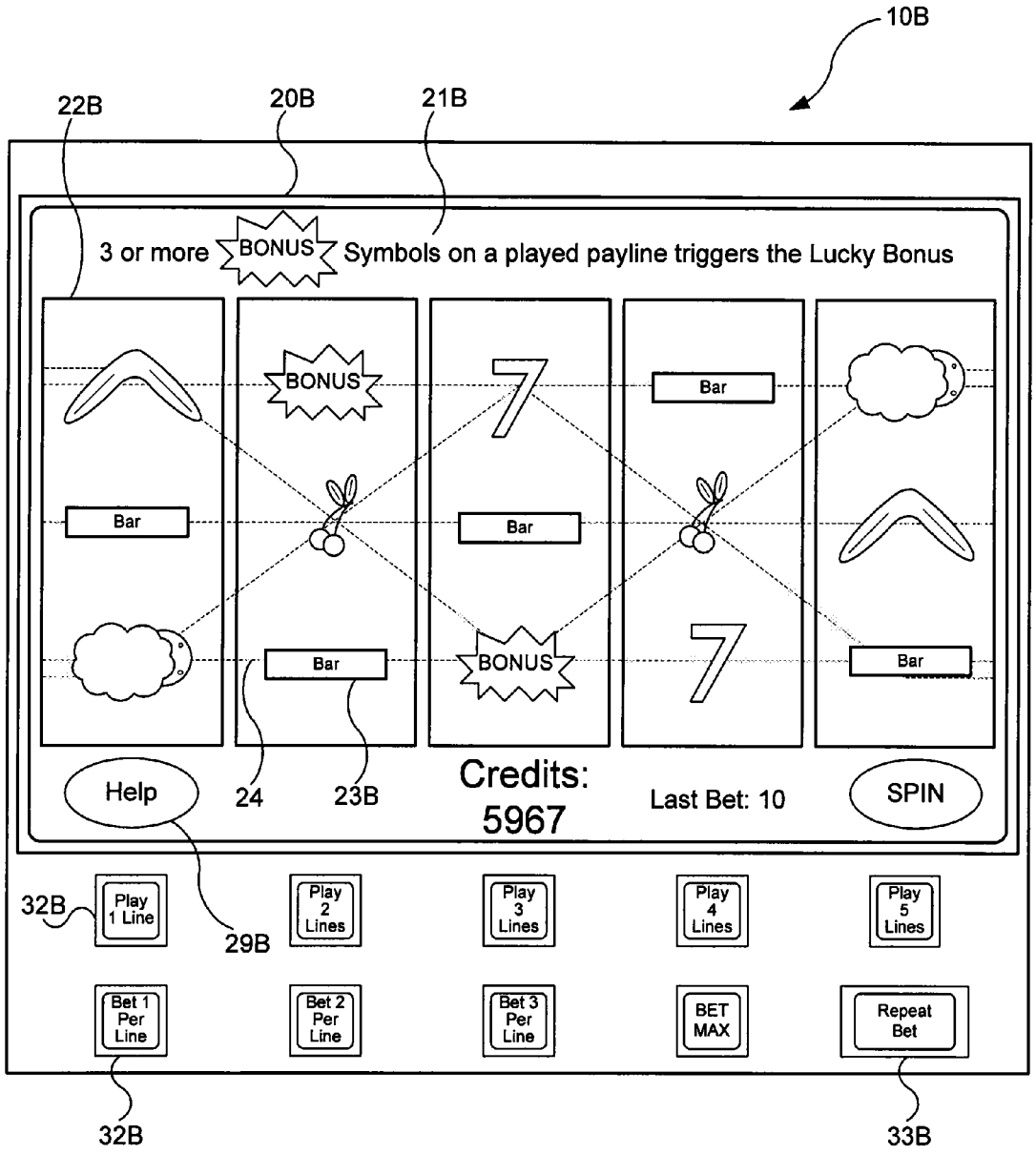
Figure 2C:
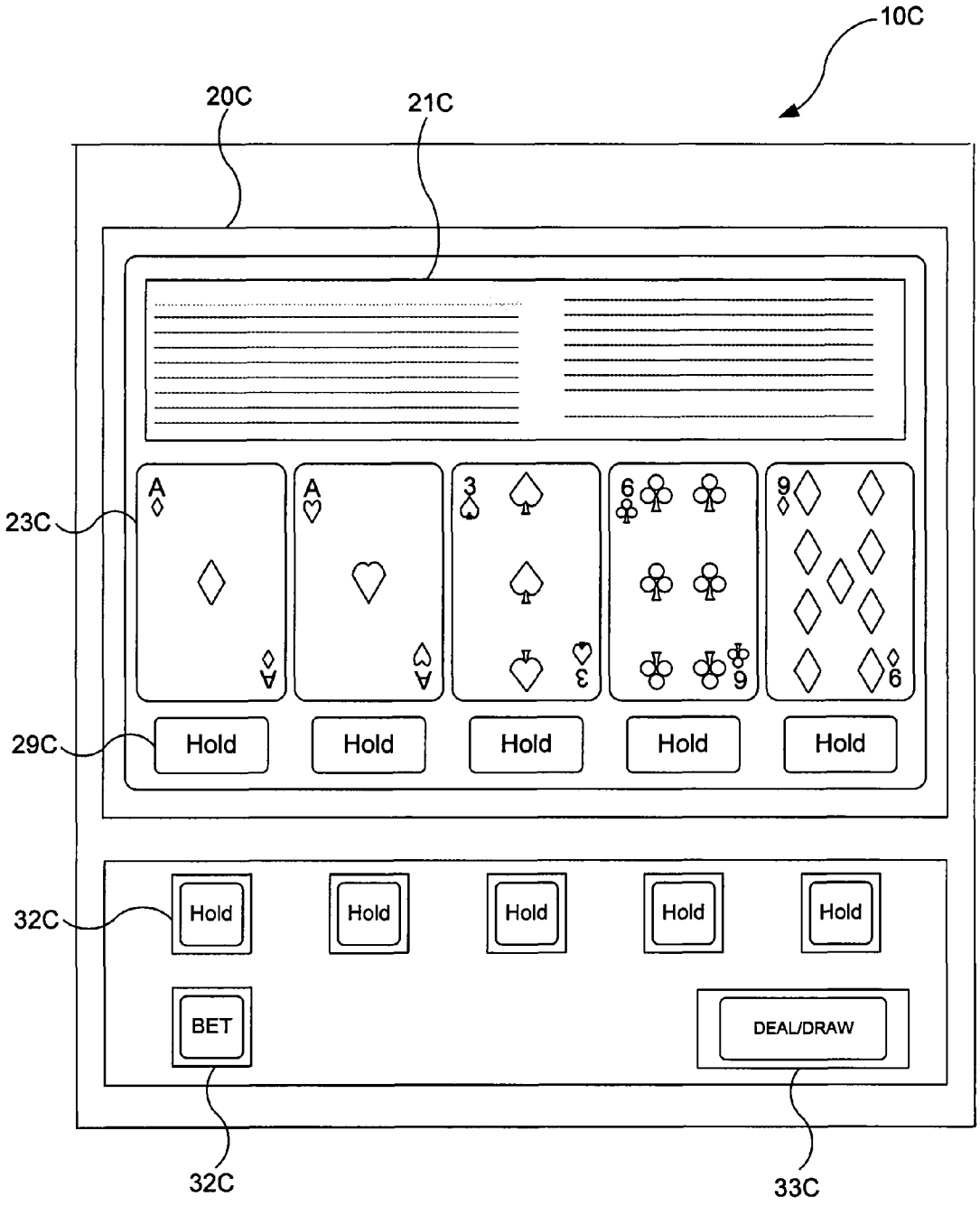
Figure 2D:
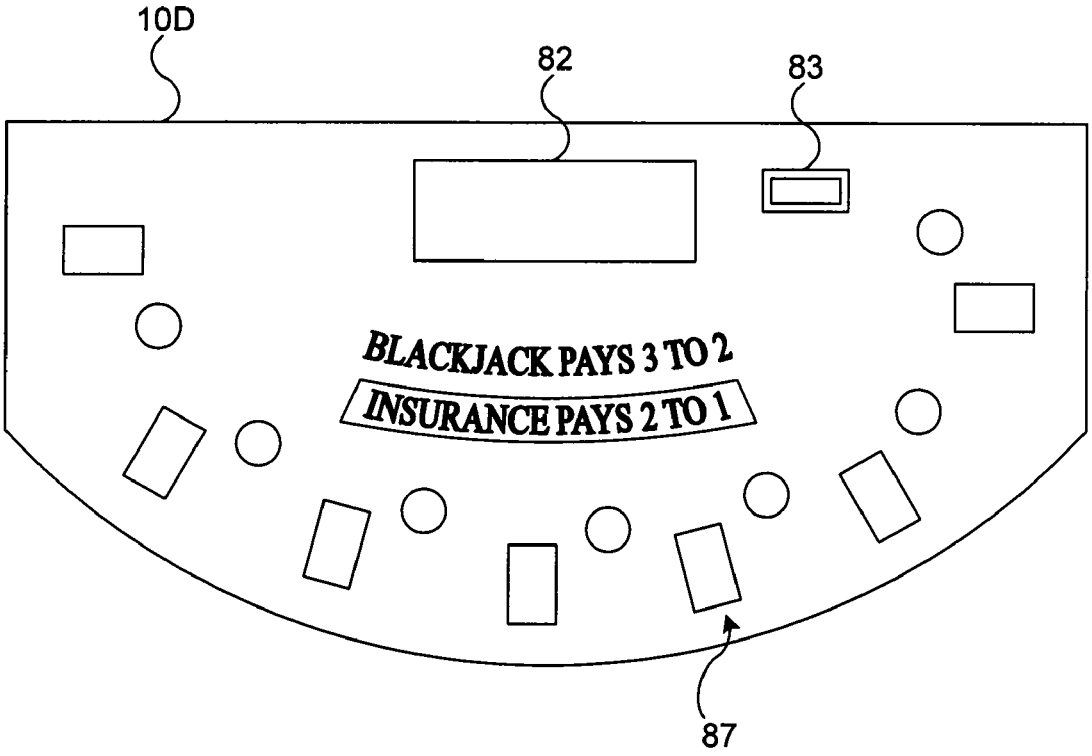

FIGS. 2A to 2D illustrate exemplary types of gaming devices according to embodiments of the invention. FIG. 2A illustrates an example spinning-reel gaming machine 10A, FIG. 2B illustrates an example video slot machine 10B, FIG. 2C illustrates an example video poker machine 10C, and FIG. 2D illustrates an example blackjack table game.

Referring to FIG. 2A, a spinning-reel gaming machine 10A includes a gaming display 20A having a plurality of mechanical spinning reels 22A. Typically, spinning-reel gaming machines 10A have three to five spinning reels 22A. Each of the spinning reels 22A has multiple symbols 23A that may be separated by blank areas on the spinning reels 22A, although the presence of blank areas typically depends on the number of reels 22A present in the gaming device 10A and the number of different symbols 23A that may appear on the spinning reels 22A. Each of the symbols 22A or blank areas makes up a "stop" on the spinning reel 22A where the reel 22A comes to rest after a spin. Although the spinning reels 22A of various games 10A may have various numbers of stops, many conventional spinning-reel gaming devices 10A have reels 22A with twenty two stops.

During game play, the spinning reels 22A may be controlled by stepper motors (not shown) under the direction of the microprocessor 40 (FIG. 1A). Thus, although the spinning-reel gaming device 10A has mechanical based spinning reels 22A, the movement of the reels themselves is electronically controlled to spin and stop. This electronic control is advantageous because it allows a virtual reel strip to be stored in the memory 41 of the gaming device 10A, where various "virtual stops" are mapped to each physical stop on the physical reel 22A. This mapping allows the gaming device 10A to establish greater awards and bonuses available to the player because of the increased number of possible combinations afforded by the virtual reel strips.

A gaming session on a spinning reel slot machine 10A typically includes the player pressing the "bet-one" button (one of the game buttons 32A) to wager a desired number of credits followed by pulling the gaming handle 12 (FIGS. 1A, 1B) or pressing the spin button 33A to spin the reels 22A. Alternatively, the player may simply press the "max-bet" button (another one of the game buttons 32A) to both wager the maximum number of credits permitted and initiate the spinning of the reels 22A. The spinning reels 22A may all stop at the same time or may individually stop one after another (typically from left to right) to build player anticipation. Because the display 20A usually cannot be physically modified, some spinning reel slot machines 10A include an electronic display screen in the top box 18 (FIG. 1B), a mechanical bonus mechanism in the top box 18, or a secondary display 25 (FIG. 1A) to execute a bonus.

Referring to FIG. 2B, a video gaming machine 10B may include a video display 20B to display virtual spinning reels 22B and various other gaming information 21B. The video display 20B may be a CRT, LCD, plasma screen, or the like. It is usually preferable that the video display 20B be a touch-screen to accept player input. A number of symbols 23A appear on each of the virtual spinning reels 22B. Although FIG. 2B shows five virtual spinning reels 22B, the flexibility of the video display 20B allows for various reel 22B and game configurations. For example, some video slot games 10B spin reels for each individual symbol position (or stop) that appears on the video display 20B. That is, each symbol position on the screen is independent of every other position during the gaming sessions. In these types of games, very large numbers of pay lines or multiple super scatter pays can be utilized since similar symbols could appear at every symbol position on the video display 20B. On the other hand, other video slot games 10B more closely resemble the mechanical spinning reel games where symbols that are vertically adjacent to each other are part of the same continuous virtual spinning reel 22B.

Because the virtual spinning reels 22B, by virtue of being computer implemented, can have almost any number of stops on a reel strip, it is much easier to have a greater variety of displayed outcomes as compared to spinning-reel slot machines 10A (FIG. 2A) that have a fixed number of physical stops on each spinning reel 22A.

With the possible increases in reel 22B numbers and configurations over the mechanical gaming device 10A, video gaming devices 10B often have multiple paylines 24 that may be played. By having more paylines 24 available to play, the player may be more likely to have a winning combination when the reels 22B stop and the gaming session ends. However, since the player typically must wager at least a minimum number of credits to enable each payline 24 to be eligible for winning, the overall odds of winning are not much different, if at all, than if the player is wagering only on a single payline. For example, in a five line game, the player may bet one credit per payline 24 and be eligible for winning symbol combinations that appear on any of the five played paylines 24. This gives a total of five credits wagered and five possible winning paylines 24. If, on the other hand, the player only wagers one credit on one payline 24, but plays five gaming sessions, the odds of winning would be identical as above: five credits wagered and five possible winning paylines 24.

Because the video display 20B can easily modify the image output by the video display 20B, bonuses, such as second screen bonuses are relatively easy to award on the video slot game 10B. That is, if a bonus is triggered during game play, the video display 20B may simply store the resulting screen shot in memory and display a bonus sequence on the video display 20B. After the bonus sequence is completed, the video display 20B may then retrieve the previous screen shot and information from memory, and re-display that image.

Also, as mentioned above, the video display 20B may allow various other game information 21B to be displayed. For example, as shown in FIG. 2B, banner information may be displayed above the spinning reels 22B to inform the player, perhaps, which symbol combination is needed to trigger a bonus. Also, instead of providing a separate credit meter 27 (FIG. 1A) and bet meter 28, the same information can instead be displayed on the video display 20B. In addition, "soft buttons" 29B such as a "spin" button or "help/see pays" button may be built using the touch screen video display 20B. Such customization and ease of changing the image shown on the display 20B adds to the flexibility of the game 10B.

Even with the improved flexibility afforded by the video display 20B, several physical buttons 32B and 33B are usually provided on video slot machines 10B. These buttons may include game buttons 32B that allow a player to choose the number of paylines 24 he or she would like to play and the number of credits wagered on each payline 24. In addition, a max bet button (one of the game buttons 32B) allows a player to place a maximum credit wager on the maximum number of available paylines 24 and initiate a gaming session. A repeat bet or spin button 33B may also be used to initiate each gaming session when the max bet button is not used.

Referring to FIG. 2C, a video poker gaming device 10C may include a video display 20C that is physically similar to the video display 20B shown in FIG. 2B. The video display 20C may show a poker hand of five cards 23C and various other player information 21C including a paytable for various winning hands, as well as a plurality of player selectable soft buttons 29C. The video display 20C may present a poker hand of five cards 23C and various other player information 21C including a number of player selectable soft (touch-screen) buttons 29C and a paytable for various winning hands. Although the embodiment illustrated in FIG. 3C shows only one hand of poker on the video display 20C, various other video poker machines 10C may show several poker hands (multi-hand poker). Typically, video poker machines 10C play "draw" poker in which a player is dealt a hand of five cards, has the opportunity to hold any combination of those five cards, and then draws new cards to replace the discarded ones. All pays are usually given for winning combinations resulting from the final hand, although some video poker games 10C may give bonus credits for certain combinations received on the first hand before the draw. In the example shown in FIG. 2C a player has been dealt two aces, a three, a six, and a nine. The video poker game 10C may provide a bonus or payout for the player having been dealt the pair of aces, even before the player decides what to discard in the draw. Since pairs, three of a kind, etc. are typically needed for wins, a player would likely hold the two aces that have been dealt and draw three cards to replace the three, six, and nine in the hope of receiving additional aces or other cards leading to a winning combination with a higher award amount. After the draw and revealing of the final hand, the video poker game 10C typically awards any credits won to the credit meter.

The player selectable soft buttons 29C appearing on the screen respectively correspond to each card on the video display 20C. These soft buttons 29C allow players to select specific cards on the video display 20C such that the card corresponding to the selected soft button is "held" before the draw. Typically, video poker machines 10C also include physical game buttons 32C that correspond to the cards in the hand and may be selected to hold a corresponding card. A deal/draw button 33C may also be included to initiate a gaming session after credits have been wagered (with a bet button 32C, for example) and to draw any cards not held after the first hand is displayed.

Although examples of a spinning reel slot machine 10A, a video slot machine 10B, and a video poker machine 10C have been illustrated in FIGS. 2A-2C, gaming machines and various other types of gaming devices known in the art are contemplated and are within the scope of the invention.

Referring to FIG. 2D, a blackjack table 10D includes a dealer position 82, a plurality of player positions 87, and a gaming medium 83. For the blackjack table 10D shown in FIG. 2D, the gaming medium may be a deck of cards or a shoe including one or more decks of cards. The blackjack table 10D may also include an automatic card shuffler (not shown). The blackjack table 10D may be a "live action table," an "electronic smart table," or a combination of the two. A live action table may include a person as the dealer that manages the betting and game play at the table 10D. An electronic smart table may include a simulated dealer and video screens (not shown) at each player position 87 to facilitate wagering and game play. A combination table may include a person as a dealer, but have electronic elements associated with each player position, such as player ID input devices, video monitors, electronic input devices, etc. (not shown) to augment game play.

Although a blackjack table is shown in FIG. 2D, any type of table gaming device may be used, such as roulette, pai gow, craps, baccarat, poker, etc. Although some aspects of these tables may vary from the blackjack table shown in FIG. 2D, the basic principles of these tables are well known in the art, and thus do not require additional explanation. Embodiments of the present concept contemplate use with all of these types of gaming devices.

Figure 3:
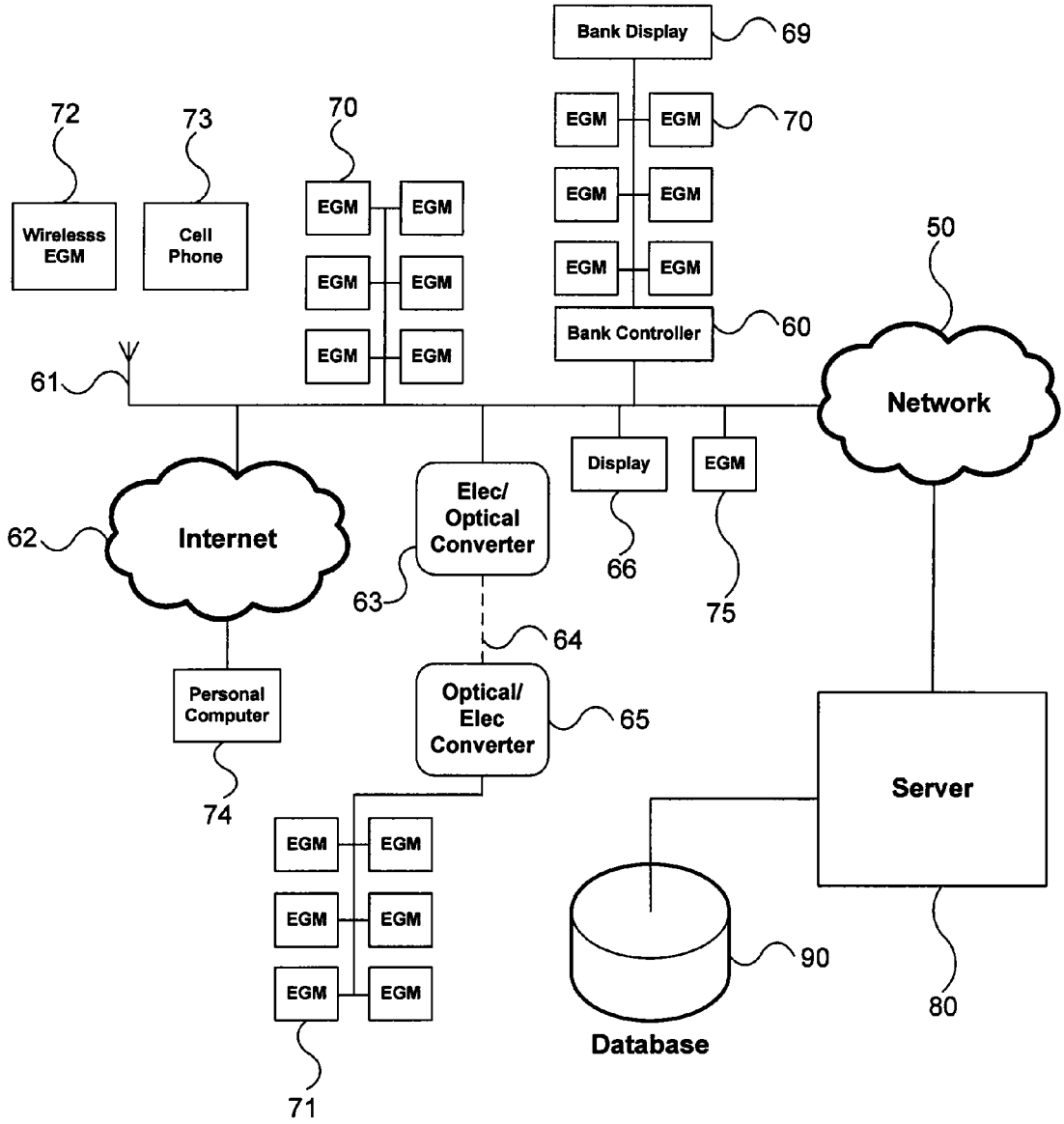
FIG. 3 is a functional block diagram of networked gaming devices according to embodiments of the invention.

FIG. 3 is a block diagram illustrating networked gaming devices according to embodiments of the invention. Referring to FIG. 3, multiple electronic gaming devices (EGMs) 70, 71, 72, 73, 74, and 75 may be coupled to one another and coupled to a remote server 80 through a network 50. For ease of understanding, gaming devices or EGMs 70, 71, 72, 73, 74, and 75 are generically referred to as EGMs 70-75. The term EGMs 70-75, however, may refer to any combination of one or more of EGMs 70, 71, 72, 73, 74, and 75. Additionally, the gaming server 80 may be coupled to one or more gaming databases 90. These gaming network 50 connections may allow multiple gaming devices 70-75 to remain in communication with one another during particular gaming modes such as tournament play or remote head-to-head play. Although some of the gaming devices 70-75 coupled on the gaming network 50 may resemble the gaming devices 10, 10A, 10B, and 10C shown in FIGS. 1A-1B and 2A-2C, other coupled gaming devices 70-75 may include differently configured gaming devices. For example, the gaming devices 70-75 may include traditional slot machines 75 directly coupled to the network 50, banks of gaming devices 70 coupled to the network 50, banks of gaming devices 70 coupled to the network through a bank controller 60, wireless handheld gaming machines 72 and cell phones 73 coupled to the gaming network 50 through one or more wireless routers or antennas 61, personal computers 74 coupled to the network 50 through the internet 62, and banks of gaming devices 71 coupled to the network through one or more optical connection lines 64. Additionally, some of the traditional gaming devices 70, 71, and 75 may include electronic gaming tables, multi-station gaming devices, or electronic components operating in conjunction with non-gaming components, such as automatic card readers, chip readers, and chip counters, for example.

Gaming devices 71 coupled over an optical line 64 may be remote gaming devices in a different location or casino. The optical line 64 may be coupled to the gaming network 50 through an electronic to optical signal converter 63 and may be coupled to the gaming devices 71 through an optical to electronic signal converter 65. The banks of gaming devices 70 coupled to the network 50 may be coupled through a bank controller 60 for compatibility purposes, for local organization and control, or for signal buffering purposes. The network 50 may include serial or parallel signal transmission lines and carry data in accordance with data transfer protocols such as Ethernet transmission lines, Rs-232 lines, firewire lines, USB lines, or other communication protocols. Although not shown in FIG. 3, substantially the entire network 50 may be made of fiber optic lines or may be a wireless network utilizing a wireless protocol such as IEEE 802.11a, b, g, or n, Zigbee, RF protocols, optical transmission, near-field transmission, or the like.

Gaming displays 66, 69 may also be connected to the server 80 through the network 50. These displays 66, 69 may be common gaming displays that show game information relating to multiple gaming devices 70-75, such as linked bonuses, multiple game station outcomes, or the like. Alternatively, the displays 66, 69 may show promotional casino information, advertisements, or other information that is to be communicated to players. The displays may be stand alone displays 66 directly connected to the network 50 or bank displays 69 connected to the network 50 through a bank controller 60.

As mentioned above, each gaming device 70-75 may have an individual processor 40 (FIG. 1A) and memory 41 to run and control game play on the gaming device 70-75, or some of the gaming devices 70-75 may be terminals that are run by a remote server 80 in a server based gaming environment. Server based gaming environments may be advantageous to casinos by allowing fast downloading of particular game types or themes based on casino preference or player selection. Additionally, tournament based games, linked games, and certain game types, such as BINGO or keno may benefit from at least some server 80 based control.

Thus, in some embodiments, the network 50, server 80, and database 90 may be dedicated to communications regarding specific game or tournament play. In other embodiments, however, the network 50, server 80, and database 90 may be part of a player tracking network. For player tracking capabilities, when a player inserts a player tracking card in the card reader 46 (FIG. 1A), the player tracking unit 45 sends player identification information obtained on the card reader 46 through the MCI 42 over the network 50 to the player tracking server 80, where the player identification information is compared to player information records in the player database 90 to provide the player with information regarding their player account or other features at the gaming device 10 where the player is wagering. Additionally, multiple databases 90 and/or servers 80 may be present and coupled to one or more networks 50 to provide a variety of gaming services, such as both game/tournament data and player tracking data.

The various systems described with reference to FIGS. 1-3 can be used in a number of ways. For instance, the systems can be used to track data about various players. The tracked data can be used by the casino to provide additional benefits to players, such as extra bonuses or extra benefits such as bonus games and other benefits as described above. These added benefits further entice the players to play at the casino that provides the benefits.

Figure 4A:
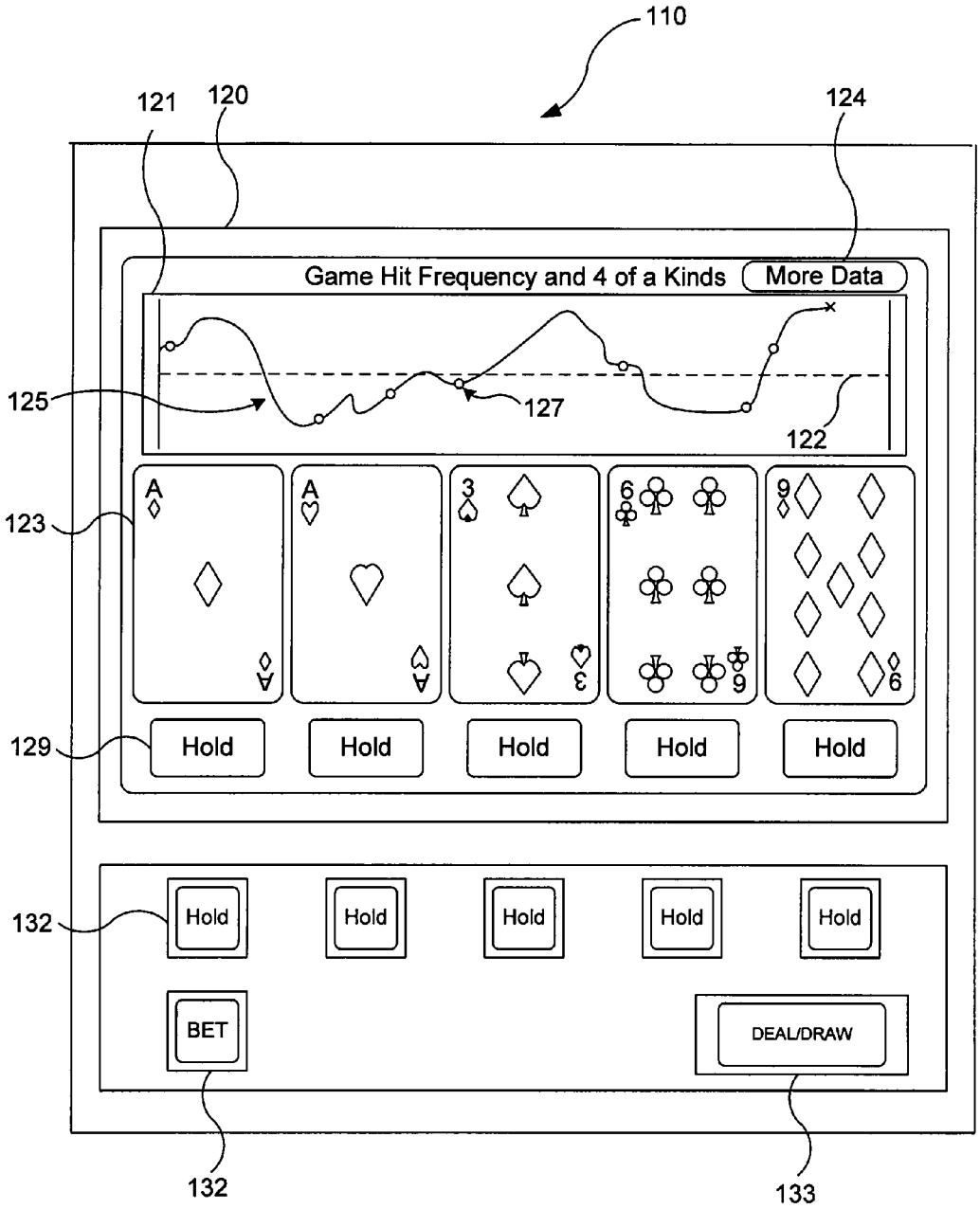
FIGS. 4A and 4B are detail diagrams of a gaming device displaying summarized gaming information according to embodiments of the invention.
Figure 4B:
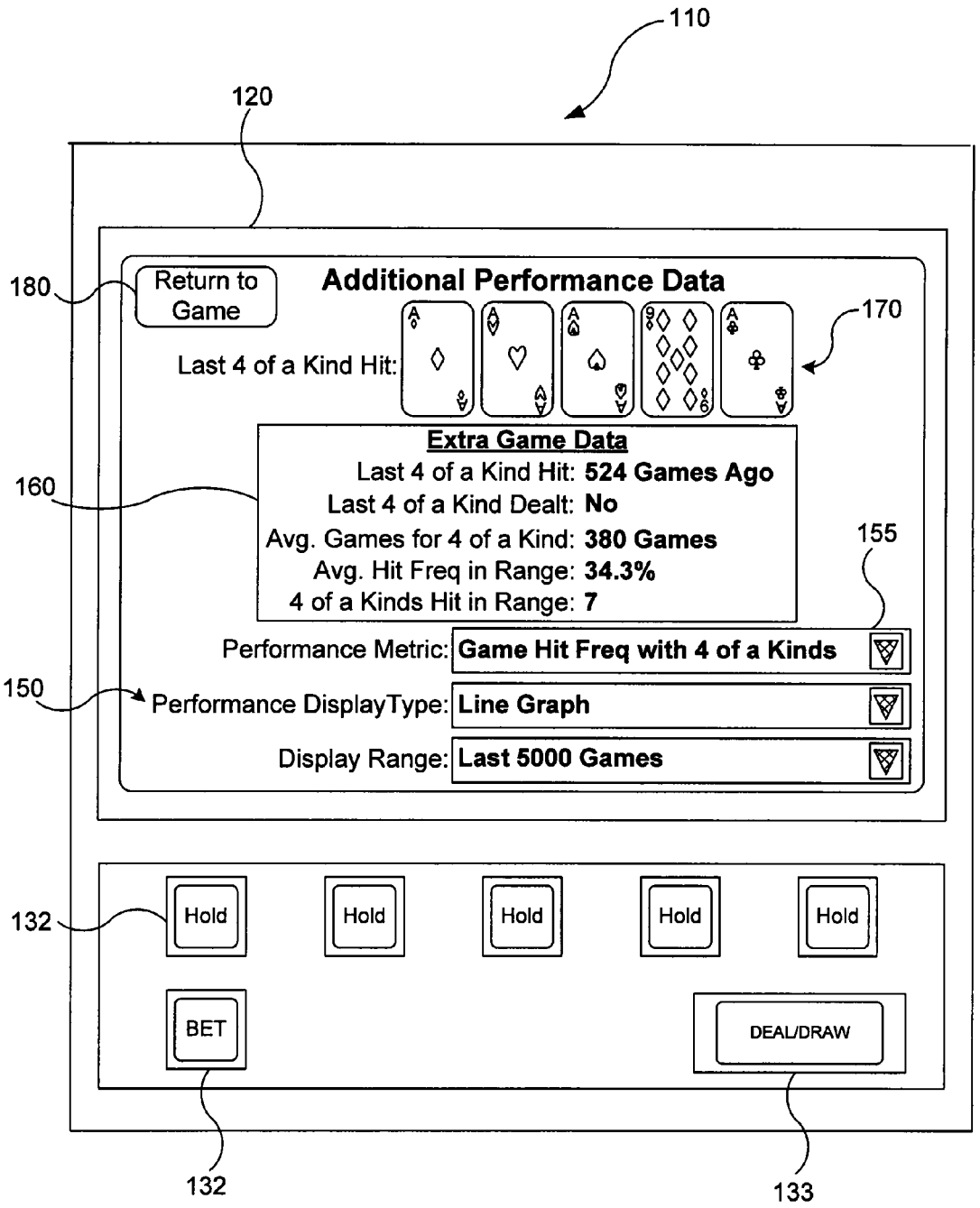

FIGS. 4A and 4B are detail diagrams of a gaming device displaying summarized gaming information according to embodiments of the invention.

Referring to FIG. 4A, a gaming device 110 has a gaming display 120 that includes both a game play display 123, 129 and a game performance display 121. As discussed in the above figures, the game play display 123, 129 shows the results of a gaming event played by a player on the gaming device 110 using game buttons 132 and/or a game initiation input device 133. The game performance display 121 is configured to show recent trends or patterns in the performance of the gaming device 110. These trends or patterns may relate to the frequency of a specific outcome (such as a jackpot, a bonus, a four-of-a-kind, a royal flush, etc.), or may relate to performance metrics of the gaming device 110, such as hit frequency, payback percentage, volatility, etc. The information shown on the game performance display 121 is preferably configured to be quickly and easily understandable to a player. Instead of rows and rows of raw game outcome numbers, the game information used in the game performance display 121 is summarized so that large ranges of data can be observed at a glance.

The gaming device 110 shown in the embodiment illustrated in FIG. 4A is a video poker machine. While specifics relating to this particular type of gaming device are discussed below with reference to FIG. 4A, this inventive concept may be embodied in a wide variety of gaming device types, such as slot machines (e.g., FIGS. 2A and 2B), live-action or electronically controlled table games (e.g., FIG. 2D), internet gaming devices (e.g., FIG. 3), wireless gaming devices, or other types of gaming devices.

The game performance display 121 shown in this embodiment is a line graph 125 of the overall game hit frequency (i.e., the frequency of a winning outcome or hand) with additional indicators 127 of when 4 of a kinds were hit. The indicators 127 may further be touched by a player to bring up a numerical indication of when they were hit. For example, a player may touch the indicator 127 furthest right on the illustrated graph and a small pop-up box may appear to indicate that the last 4 of a kind was hit 524 games ago. Various other information may also or alternately be linked to these indicator 127 icons. The small pop-up box may disappear after a brief time lapse, on a second touch by the player, or on any other player action on the gaming device. In other embodiments, each indicator 127 may include a fixed indication of how long ago they occurred. That is, instead of only displaying this information when requested by a player (via the player touching the indicator 127), the information may be consistently displayed with each indicator for quicker reference.

A reference line 122 is also included in the game performance display 121 to provide a theoretical hit frequency value to which the line graph 125 of the actual game hit frequency may be compared. Looking at the line graph 125 of the game performance display, it can quickly be ascertained that the game has had a very good hit frequency recently (i.e., note that the right side of the line graph 125 is substantially above the theoretical hit frequency line 122). Some players may observe this line graph 125 and determine that the gaming device is "hot" or likely to continue to provide a high hit frequency, even though future game results are typically determined at random. Other players may note that the every time this game has reached a high frequency it has dramatically dipped to a lower-than-theoretical hit frequency. In other words, these players are noting an apparent or perceived trend for this gaming device 110. These players may search out a different gaming device that has a trend more favorable to them.

Since many performance metrics will approach a theoretical value given a big enough sample size, these game performance displays 121 may show metrics over a limited number of games or time. For example, the hit frequency line graph 125 in this embodiment is calculated at any given point by comparing current game events and the previous 99 games. Thus, any given point on the line graph is taking into account only the previous 100 game events. This allows for fluctuations in the graph that reflect the recent performance of the gaming device 110. On the other hand, it would be a relatively uninformative to have a sample size too small because this could lead to wild swings in the graph without telling players much about the trends associated with the gaming device.

To see additional historical data, a player may use the "More Data" button 124 to view additional historical game data not presently shown on the game performance display 121. In some embodiments, this option will let a player scroll back and forth on the graph to show the historical game data and the progression from the historical game data to the present game data. For example, a player may specify that they want to go back 5000 games to see the progression of the game's hit frequency and any perceivable trend or pattern. The graph may jump back 5000 games and then automatically scroll right to left until it reaches the display of the current game information. The "More Data" button 124 may display these or other options on a portion of the game display 120, or on another display associated with the gaming device 110. FIG. 4B illustrates an example embodiment of the game display 120 when the "More Data" button 124 has been activated.

Referring to FIG. 4B, the game display 120 of the gaming device 110 has entered a second screen mode to display various game information and game information options that were not previously displayed on the game performance display 121. This additional screen may prevent the game performance display 121 from being overly cluttered, or confusing newer players while still providing some players with the ability to ascertain additional game information details and/or alter the type of display used with the game performance display 121.

In the second screen display shown in the embodiment illustrated by FIG. 4B, the gaming display 120 includes an extra game data portion 160, a game performance display portion 150, and a particular historical game data portion 170. Additionally, this secondary screen includes a "Return to Game" button 180 so that the player can easily return to the primary game display associated with the game. The extra game data portion 160 may include various other information that a player may find useful in determining patterns or trends in game play, which in turn may enhance the playing experience. This other information may include the last 4 of a kind hit, a determination of whether the last 4 of a kind was received on the deal or the draw, the average games over the range between 4 of a kinds, the overall average hit frequency of the game over the range, and the number of 4 of a kinds hit in the range.

The game performance display portion 150 may include pull-down menus 155 associated with various game performance display 121 options, such as performance metrics to show, a type of performance display, and a display range. The particular historical game data portion 170 may be set to show specific information that a player may find to be valuable, such as the hand for the last 4 of a kind that was hit. This portion 170 of the display may allow a player to see which cards formed the 4 of a kind, and what the kicker (other) card was. In some embodiments, only some of these options may be available to certain types of players. For example, the options of changing the display type or looking at past hands may be limited to identified players (such as players that are part of a player loyalty club) or valued players meeting one or more criterion such as an average coin-in minimum.

Figure 5A:
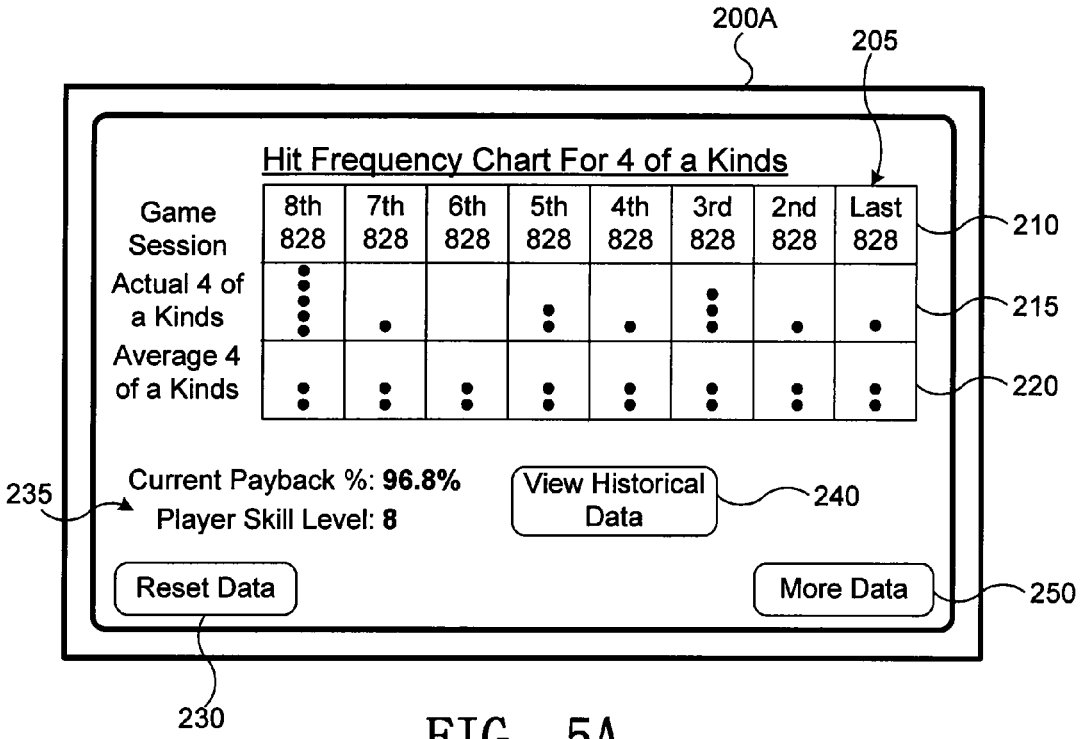
FIGS. 5A and 5B are detail diagrams of displays showing exemplary types of summarized gaming information according to embodiments of the invention.

The more data button 124 may also be used to change the type of display, the ranges associated with the display, or the type of information that is being displayed. For example, a player may choose to see a chart based list of four of a kind hits (FIG. 5A). Alternatively, a player may choose to have only the last 100 games displayed on the game performance display 121 instead of 200 games. On the other hand, a player may want to see how many royal flushes have been hit or to see a line graph of the games payback percentage. In some embodiments, the player may search for particular results and have the game performance display "jump" or move to the next instance of the particular result. For example, if the player wanted to review the line graph pattern after a Royal Flush, the player may be able to jump between graphical displays of past instances when Royal Flushes were hit. In other embodiments, the display may segment into several portions to show the past instances of Royal Flushes and the nearby historical data. This option may allow a player to quickly review the game data pattern surrounding the last five Royal Flushes on one screen, for example. Additional details and options associated with this game performance display 121 are discussed below in various embodiments of the present concept.

Referring again to FIG. 4A, although the game performance display 121 is shown on the gaming display 120, in other embodiments, the game performance display 121 may be shown on a separate display screen, such as a secondary display 25 (FIG. 1A), a top box display, or a remote display separate from the gaming device 110. If the game performance display 121 is shown on the gaming display 120, it may be shown substantially simultaneously with the game play display 123, 129 (as shown in the embodiment illustrated in FIG. 4A). In other embodiments, however, the game performance display 121 may be shown at periodic intervals with other game information, such as a banner or paytable, during game play. The player may also press a gaming button 132, soft button 129, or other player input device to bring up and/or manipulate the game performance display 121. During this request, the game performance display 121 may be displayed along with the game player display 123, 129, or may replace the game play display 123, 129. Additionally, when the game is not in play, the game performance display 121 may be used as part of an attract screen to alert players to the recent performance of the gaming device.

In some embodiments, the game performance display 121 may have shading, coloration, or other special formatting associated with the display to provide additional emphasis to certain aspects of the summarized game data. For example, the line of the line graph 125 may be colored red (and/or bolded, etc.) when it is above the reference line 122 to emphasize that the game is doing better than a theoretical metric. Here, the line graph 125 may be colored blue (and/or be dashed, etc.) when it is below the reference line 122. Alternatively, the area between the line graph 125 and the reference line 122 may be colored or shaded. For example, when the line graph 125 is above the reference line 122, the area between the line graph and the reference line (the area under the curve) may be colored red to signify that the game is doing better than an expected average. Similarly, when the line graph 125 is below the reference line 122, the area between the line graph and the reference line may be colored blue. Additional or different coloration, shading, or formatting schemes may be used in other embodiments to provide similar information or emphasis to a player.

Historical game data used in the game performance display 121 may be maintained in the gaming device memory 41 (FIG. 1A) or maintained in a remote database 90 (FIG. 3) connected to the gaming device via a network 50. Even when the historical game data is maintained in a remote database 90, the local gaming device memory 41 may be used to temporarily store game data information. This temporality stored data may be transferred to the remote database 90 periodically and/or in response to a triggering event, such as a player cashing out or otherwise ending a game session. Here, a remote server 80 (FIG. 3) and a game processor (40 (FIG. 1A) may be used to coordinate and otherwise facilitate this transfer of game information. The server 80 may include a receiver, such as an input port, to receive game information recorded and/or stored at the gaming device 110. The server 80 may also include a processor that processes or summarizes the transferred game information and generates the visual depiction of the summarized game information that is to be displayed to the player. A transfer unit may further be included in the server 80 to transfer this visual depiction to the gaming device 110 so that an updated image of the summarized game information can be shown on the game performance display 121.

In some embodiments, the ability to provide a game performance display 121 may be downloaded to a gaming device 110 from a remote server 80 (FIG. 3) if requested by a player and/or if the player meets predetermined criteria. That is, a pattern play module may be transferred to a gaming device 110 to provide the gaming device instructions or directives for displaying a game performance display 121 on at least one of the existing displays associated with the gaming device 110. Here, the pattern play module may direct the gaming device to maintain the stored game data as well as process and display a summarized form of the game data. Alternatively, the pattern play module may direct the game device to periodically transfer recorded game data to the server 80 to be processed and returned in summarized/graphical form for display to a player as discussed above. By utilizing pattern play modules, existing gaming devices could be modified to provide a game performance display 121 to players. Pattern play modules may also be an option for a server based gaming environment where players download games to game device terminals.

There are several advantages of maintaining historical game data records on a remote database 90. These advantages include the flexibility of processing data for a particular player over multiple game devices, for particular types of game devices, or even gaming devices spread across related casino properties. Here, the remote game data can be accessed by any gaming device that is connected to the remote server 80 and utilized in preparing relevant game performance information for a player of the gaming device 110.

Figure 5B:
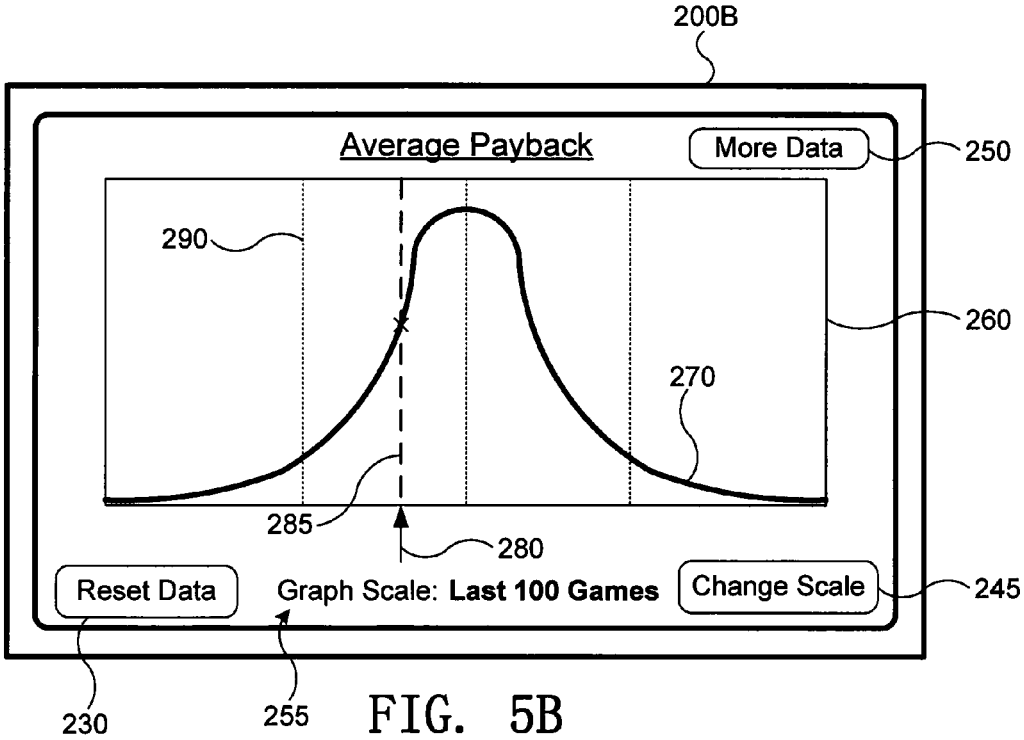

FIGS. 5A and 5B are detail diagrams of displays showing exemplary types of summarized gaming information according to embodiments of the invention.

Referring to FIGS. 5A and 5B, game performance displays 200A and 200B are shown with different formats of summarized gaming information. As discussed above, various styles of summarized game data may be presented to a player, which may be dictated by the type of gaming device, the type of summarized gaming information requested, and/or the preferences of a particular player. The game performance displays 200A and 200B are shown as individual displays, but they may take any of the forms of the game performance displays discussed above.

The game performance display 200A shown in the embodiment illustrated in FIG. 5A includes a hit frequency chart 205 for four of a kinds that includes summarized data of recent four of a kinds that have hit in a video poker game over eight predetermined game session intervals 210. More specifically, the chart 205 shows the actual number of four of a kinds 215 that have hit within each game session interval 210 and the average or theoretical number of four of a kinds 220 for each of the game session intervals 210. For this video poker game, the game session interval 210 has been set at 828 hands played, within which two four of a kinds hit on average (or a four of a kind every 414 hands). These game session intervals 210 may be set by the casino or by the player. In either case, there may be a pull down menu that limits the interval size to a few predetermined numbers, or the operator or player may input a desired value. Here, since the number of four of a kind hits are shown by a symbol (circle), it may be difficult to show the expected number of four of a kinds that will hit in, for example, 100 hands (i.e., it will not be a round number). Although the symbol illustrated in this embodiment is a circle, any symbol could be used.

In other embodiments, the actual hits 215 and theoretical hits 220 may be shown by numerical values. This format may allow for more flexible game session intervals 210 to be set, but may not be as intuitive or easily understandable as the symbol based version shown in FIG. 5A. Referring to the illustrated chart 205, one four of a kind has been hit in the last 828 hands (the rightmost column), one four of a kind was hit in the 828 hands prior to that (last $829^{th}$ to $1656^{th}$ hands), three were hit in the 828 hands before that, etc. A player observing this summarized data may conclude that the gaming device has been cold lately and will not likely have many four of a kinds hit in the near future. However, another player may see this data and conclude that the gaming device is due for a large number of four of kinds to be hit in the near future. Still other players may see a pattern in the number of 4 of a kinds that hit during consecutive intervals 210. In some embodiments, shading or coloration may be utilized to emphasize the relative performance of the actual hits 215 in each game session interval 205. For example, the left most actual hit column 215 that had five four of kind hits in that game session interval 205 may be colored red, while the $6^{th}$ game session interval that had zero four of kind hits may be colored blue.

The game performance display 200A also includes summarized game data information 235, such as statistical information, shown separately from the hit frequency chart 205. In the embodiment shown in FIG. 5A, the statistics 235 currently show the payback percentage of the game and player skill level. The payback percentage may reflect the payback percentage during the current game session interval 210, over a different predetermined interval, or for a game session of the current player. The player skill level may reflect a player's relative skill as compared to a theoretical player playing a perfect highest-payout strategy. Player skill level may be a range of numbers (e.g., 1 to 10) or other indication showing a player's relative skill. Measurements of player skill typically make more sense in games that allow a player to make decisions that affect the payback percentage of the game, such as video poker or blackjack. The outcomes of games such as roulette, craps, or slot machines are dictated completely by random play, and hence a player's "skill level" may be difficult to assess, and may not be included with these games.

One or more player interface devices (e.g., 230, 240, and 250) may also be associated with the game performance display 200A. In this embodiment, the game performance display 200A includes a reset button 230, a historical data button 240, and a more data button 250. The reset button 230 may reset at least some of the summarized game information on the game performance display 200A. For example, the reset button may completely clear the actual hits 215 on the hit frequency chart 205, or it may only reset the current game session interval 210 (i.e., the rightmost column). The reset button 230 may alternatively, or in addition, reset the summarized game data statistics 235.

The historical data button 240 may allow a player to see additional game session intervals 210, a longer range of data for the summarized game data statistics, or otherwise manipulate the game performance display 200A to show historical game data not otherwise shown. If the reset button 230 is used to clear some or all of the displayed summarized game information, the historical data button 240 may be used to re-display the cleared historical data.

The more data button 250 may allow a player to alter various parameters regarding the display of the summarized game data. That is, by pressing the more data button, a player may change the format of the summarized game data (e.g., changing the hit frequency chart to a line graph), changing the range of data displayed (e.g., changing the game session intervals 210 from 828 hands to 414 hands per interval), or changing the type of summarized game data (e.g., change the chart 205 from showing the hit frequency of 4 of kinds to the hit frequency of royal flushes). The more data button 250 may also be used by the player to save, print, or otherwise memorialize the game performance data. For example, if a player wants to save their personal performance on a gaming device, the player may use the more data button 250 to access a menu that lets the player save the data to a player loyalty account (if they are a member of player loyalty club), or print the data on a ticket printer (FIG. 1A) attached to the gaming device, or another printer that may be attached to the gaming device or remote from the gaming device. The player may even be able to email or text the data to a home computer or wireless device.

Referring again to FIG. 5B, the game performance display 200B includes a bell curve graph 260 that represents the average payback percentage of the gaming device. The bell curve line 270 of this graph 260 does not move in this display embodiment in response to game play. Rather, a measurement line 285 moves left and right across the graph 260 as game results occur and dynamically change the payback percentage. The highest center point of the graph 270 may be associated with the theoretical payback percentage of the gaming device. Thus, when the measurement line 285 moves to the right of the center point, the current payback percentage of the gaming device is better than its theoretical average, which may indicate a "hot" machine. On the other hand, when the measurement line 285 moves to the left of the center point, the current payback percentage of the gaming device is worse than its theoretical average, which may indicate a "cold" machine or a machine that is "due."

Indicator lines 290 may be provided on the graph 260 to give the player a relative idea of how the game has been performing in relation to a theoretical metric. In the embodiment shown in FIG. 5B, one indicator line 290 represents the theoretical payback average (the middle one passing through the highest point of the bell curve 270), while the other two represent some measure of displacement away from the theoretical average, such as two standard deviations. Because many casinos and gaming venues do not like to advertise the theoretical payback percentage of games, no actual numbers may be used with the graph 260. Thus, while the player may still be able to judge how they are doing versus a theoretical payback percentage, the actual theoretical payback may still remain confidential.

Graph shading or coloration may also be used to emphasize how the current game performance is doing versus the theoretical payback percentage. In some embodiments, the whole graph color may change depending on the position of the measurement line 285. In other embodiments, only portions of the graph on either side of the measurement line 285 may change as the line moves.

The game performance display 200B also includes a graph scale indicator 255 and a change scale button 245. The graph scale indicator 255 may be used to show how many gaming events are being considered in the average payback calculation for the measurement line 285. When games are being continually played, the last data point may be discarded and the new game result may be added when making the calculation. The change scale button 245 may be used to alter the scale of the graph 260. This may allow players to see a wider or narrower range of data used in the calculations (e.g., changing the graph scale from the last 100 games to the last 500 games). In addition, the change scale button 245 may be used to change the variable over which the average payback is calculated (e.g., changing the graph scale from the last 100 games to the last 30 minutes). As discussed above, the scale for the summarized data can be set for numerous types of metrics, such as games played, time, player based, event based, etc.

The measurement line 285 may also be accompanied by a player indicator 280. In the embodiment shown in FIG. 5B, this player indicator 280 is a simple arrow that draws attention to the player measurement line 285. However, the indicator 280 may be symbol chosen by the player, such as a lucky symbol, graphical representation of the player, or another type of player avatar. If the player has a player loyalty account with the casino, the player may have a preferred avatar downloaded to the game when they identify themselves to the gaming device (such as when they insert their player ID card in the gaming device). Other players may choose from a menu of predetermined symbols, or transfer a personal symbol from a wireless device or other means to the gaming device.

Figure 6A:
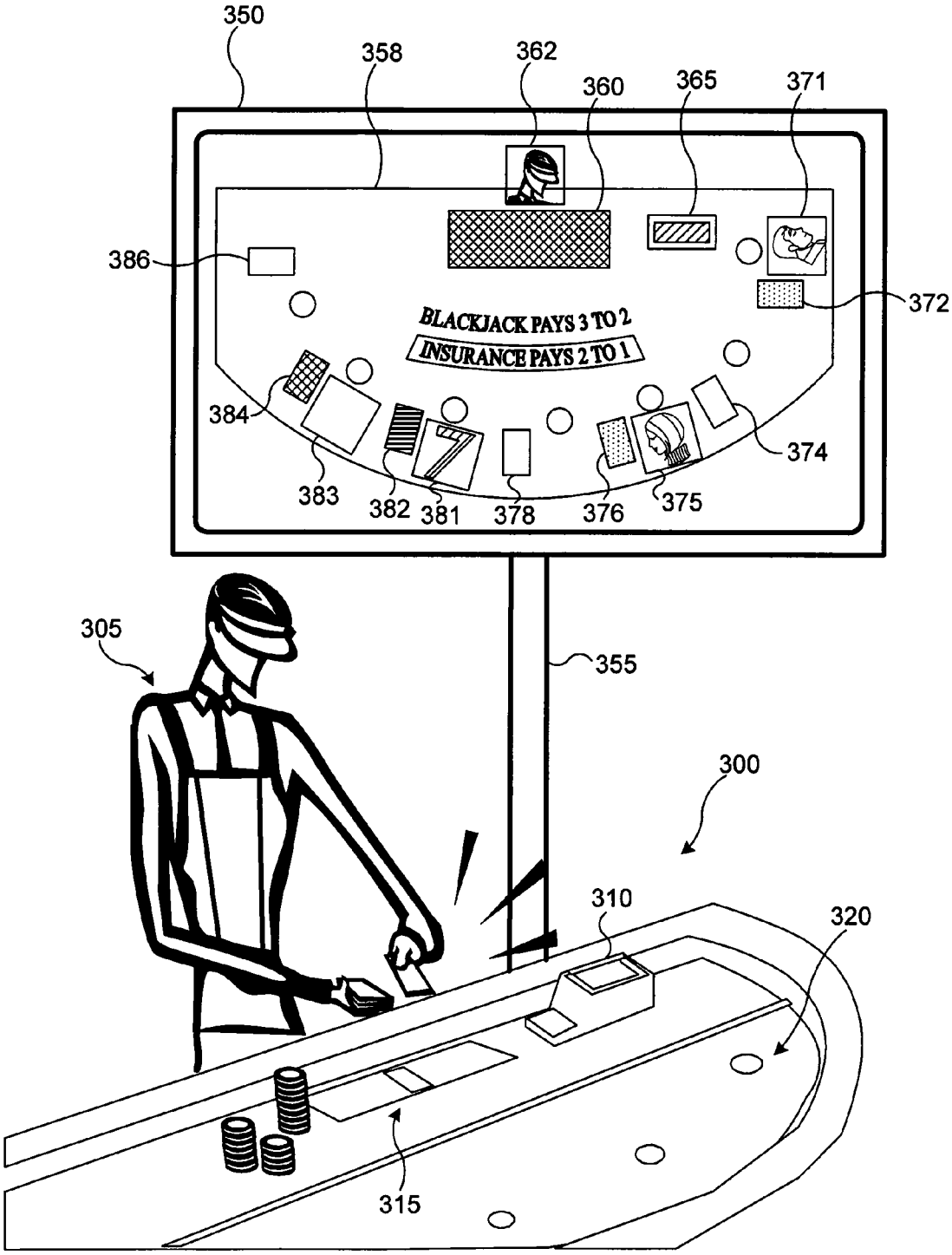
FIGS. 6A and 6B are detail diagrams of a table gaming device displaying summarized gaming information according to embodiments of the invention.
Figure 6B:
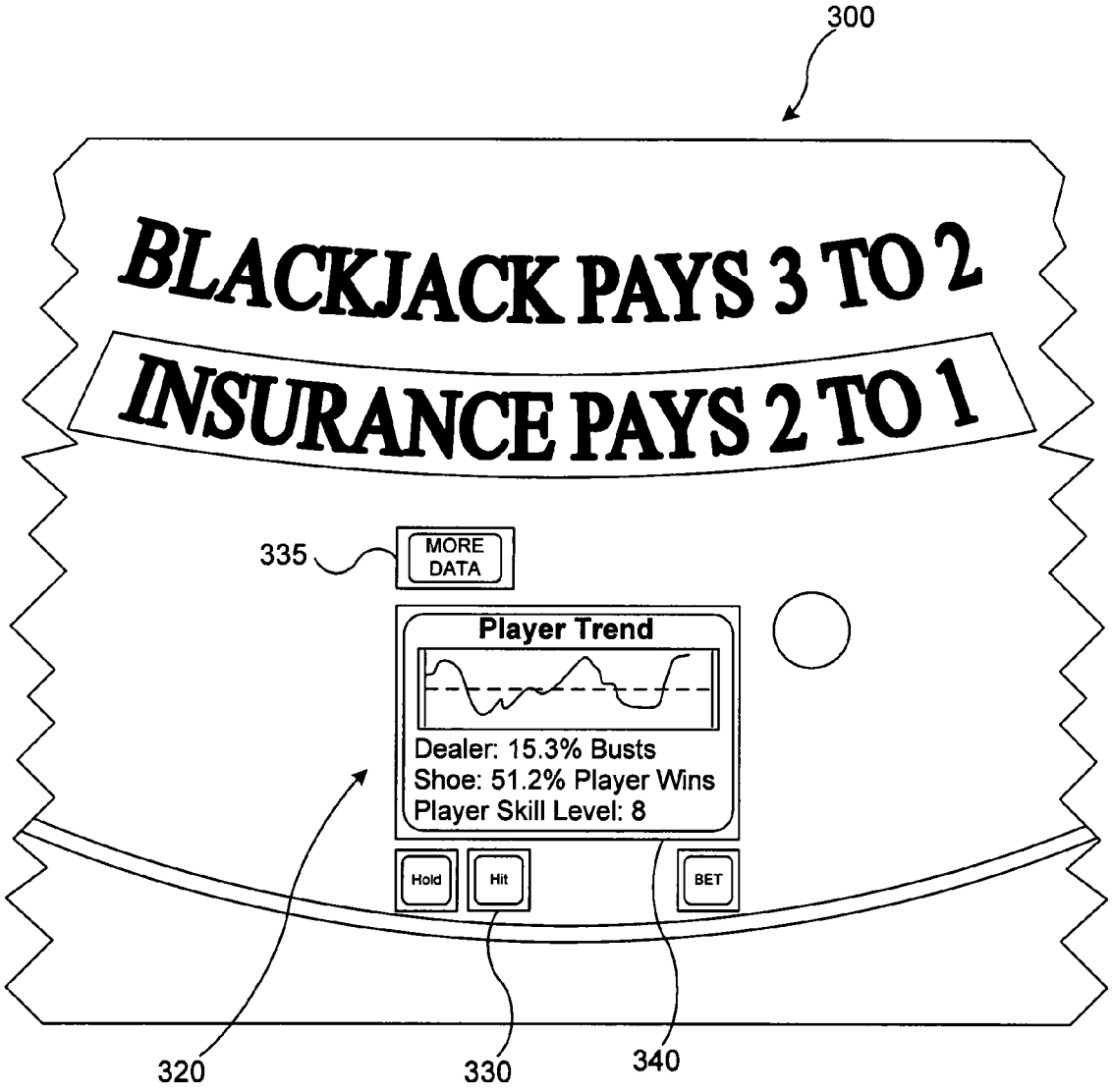

FIGS. 6A and 6B are detail diagrams of a table gaming device displaying summarized gaming information according to embodiments of the invention.

Referring to FIG. 6A, a gaming device 300 includes a plurality of player stations 320 and a game performance display 350 mounted to a support structure 355. In this embodiment, the gaming device 300 is a live action blackjack table with a dealer 305 dealing cards from a shoe of cards 310. The live action black jack table of this embodiment also includes a card reading device 315 that recognizes the cards that are dealt out of the shoe 310. The card reading device 315 acts as a recorder of game information so that game results can be tracked, processed into summarized data, and displayed on the game performance display 350. The card reader 315 may automatically determine which player station 320 receives a dealt card and keep track of the overall hands of each player station 320. The automatic determination may be accomplished by directional sensors, in conjunction with pressure sensors at each player station 320, in conjunction with RFID readers configured to read RFID devices embedded in the cards or other play mediums, or in conjunction with an overhead camera. Alternatively, the dealer 305 or other casino personnel may manually input the location of a dealt card. In other embodiments, an overhead camera with card recognition ability may be used independently to record game play on the gaming device 300. If the gaming device is an electronic table, game play may be recorded and tracked by an internal processor. Additionally, wagers may be tracked so that monetary wins or overall money won versus money wagered can be included on the game performance display. For live action tables, RFID detectors may be used to track RFID devices embedded in the gaming chips that are used for wagering.

The game performance display 350 includes a graphical representation 358 of the gaming device 300. This graphical representation 358 may allow players at the gaming device 300 or prospective players looking for a table to play a quick but informative indication of how that game device, or configuration, has been performing. Unlike single player gaming devices, such as slot machines or video poker machines, table games often include many more game play variables that may be of interest to players. Although game performance displays 350 may be relatively simplistic in the information they display (e.g., numerical indicators of hands won versus hands lost at each gaming station 320), it may be preferable to include a variety of information that a player might find valuable in choosing a table to play at.

In the game performance display 350 illustrated in this embodiment, the graphical representation 358 of the blackjack table includes color coded indicators for a dealer 360, and for each gaming station 372, 374, 376, 382, 384, and 386. A color coded indicator for a shoe of cards 365 is also included. The dealer indicator may represent how favorable a particular dealer has been to the players at the gaming device. That is, a dealer's indicator may turn a warmer color, such as red, when the players at the table are doing well. When the dealer rotates, the dealer indicator 360 may be reset to a neutral color, or the dealer's indicator from another game may be transferred to the gaming device to which they moved. The shoe indicator 365 may be reset each time the cards in the shoe are shuffled (i.e., at the start of a new shoe), or at a periodic time or rolling number of hands. A dealer avatar or representation 362 may also be associated with a dealer 305 to emphasize a dealer's identity. Each dealer may choose an avatar symbol, or an image of each dealer may be used.

The gaming station indicators 372, 374, 376, 382, 384, and 386 may show how a relative gaming position 320 at the gaming device 300 is performing. This indication is different than an indicator of how a particular identified player is doing. That is, the position indicators may show the relative success of a particular gaming position 320 even though multiple different players have played at the position over the period from which the calculations are determined. An identified player's performance indicator (and skill level indicator), on the other hand, follows that player between different gaming stations and gaming devices. In the embodiment illustrated in FIG. 6A, the first gaming position indicator 372, third gaming position indicator 376, fifth gaming position indicator 382, and sixth gaming position indicators 384 are shaded or colored to indicate how those respective positions are doing. The second, fourth, and seventh gaming position indicators 374, 378, and 386 are blank, which may mean that player has not played at that gaming station for the predetermined interval over which the game performance is being shown.

Players at the first, third, and fifth gaming positions have associated a player avatar with their respective player position. The player at the first gaming station has been associated with a player indicator 371 representing the player. Similarly, the player at the third gaming station has been associated with a player indicator 375 representing the player. The player at the fifth gaming station has been associated with a player indicator 381 that is represented by a lucky symbol. As discussed above, a player indicator may be associated with a player when the player identifies himself or herself, or may be chosen or assigned to the player. The player at the sixth gaming station has a blank player indicator 383 because the player has not been identified and has not otherwise selected a symbol to be a player indicator.

In this embodiment, a position indicator 372, 374, 376, 382, 384, and 386 is shown for each represented gaming position. These position indicators may be shaded or colored to show how well a particular gaming position has been performing. Similarly, the backgrounds of the player indicators 371, 375, 381, and 383 may be shaded or colored to show how well a particular player is performing. Although not shown in this embodiment, a player skill rating may also be assigned and displayed for each player. This skill rating may differentiate between players that are playing an optimum strategy and players who are not, such as is discussed above with respect to FIG. 5A. Additionally, although a map style graphical representation 358 of the gaming device 300 is shown in this embodiment, various other display schemes may be employed to convey game performance information to players. For example, trend graphs or numerical data may be associated with each gaming position, player, dealer, or shoe. In some embodiments, historical performance data may be displayed on the game performance display in addition to or alternately with current performance data. For example, historical performance data may be displayed periodically during game play, at natural breaks in the action (dealer change, deck reshuffle, etc.), or when there is no gaming activity on the gaming device. Additionally, although the gaming device shown in this embodiment is a live action blackjack table, game performance displays of a similar nature may be employed for various other table games, such as baccarat, roulette, craps, pai gow, poker, etc.

Referring to FIG. 6B, a gaming table or other gaming device 300 includes a personalized game display 340 associated with a player station or position 320. This configuration may be used with gaming tables that utilize electronic wagering and/or game play, smart tables, gaming machines that include linked bonuses or game play, or any other gaming device that includes multiple player stations 320. The player station 320 shown in the embodiment illustrated in FIG. 6B includes a display 340, a plurality of game buttons 330, and a more data button 335. The display 340 may show an amount wagered and/or game play depending on the configuration of the gaming device 300, although not shown in FIG. 6B. The display 340 may show a replica of common game performance display 350 (FIG. 6A), or may show more personalized player specific data for the player at the particular player station 320. For example, the display 340 may show a player trend graph that shows historical game performance data of the player (e.g., hands won vs. hands lost) whereas the common performance display 350 may only show a color or shade associated with the game position 320 and/or the particular player at the game position 320.

The player station display 340 may also show various other game performance information, such as the percentage of hands where the dealer busted, the percentage of total player wins associated with a shoe of cards, a player's relative skill level, game performance data of other game positions or players, or any of the other options discussed above or associated with a particular game device. The player station display 340 may include a touchscreen, or game buttons 330 may be used to manipulate objects shown on the display 340. Additionally, the display 340 may include a soft button for "More Data" or a physical button 335 may be included to manipulate objects shown on the display 340 or show additional game performance information as discussed above.

Figure 7A:
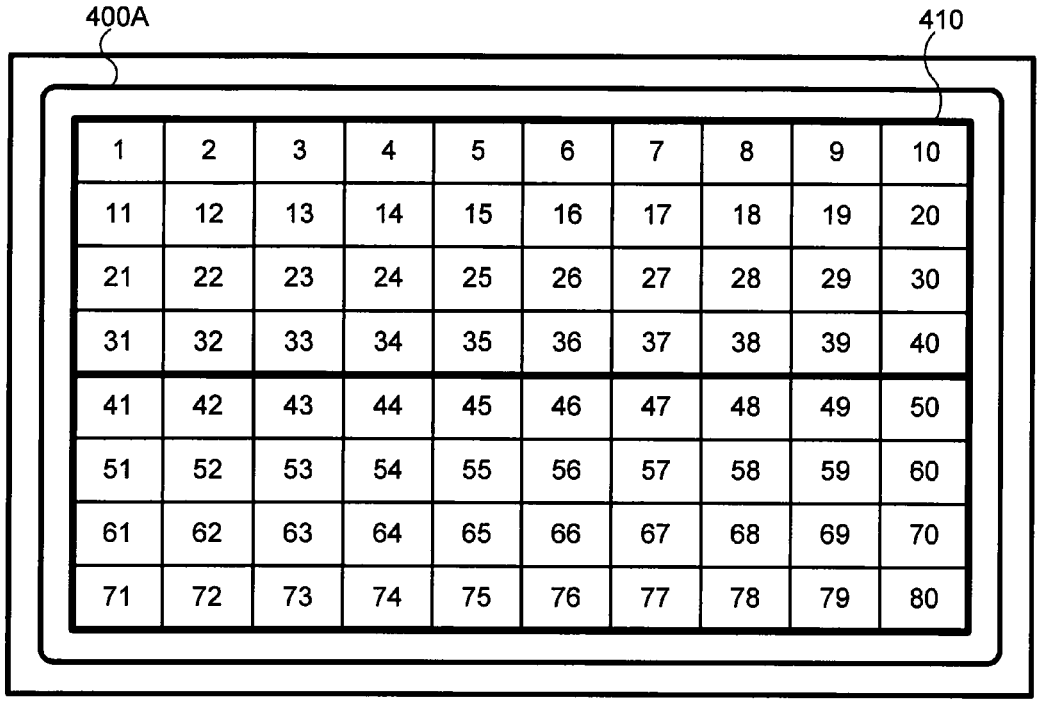
FIGS. 7A and 7B are detail diagrams of exemplary types of displays for displaying summarized gaming information according to embodiments of the invention.
Figure 7B:
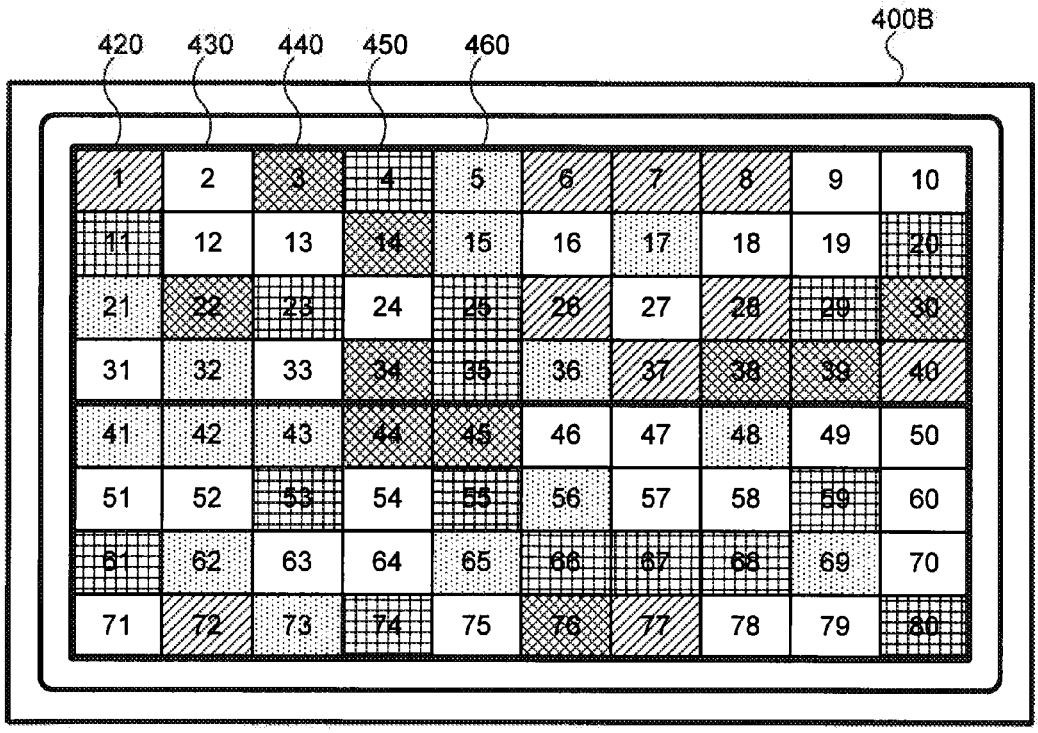

FIGS. 7A and 7B are detail diagrams of exemplary types of displays for displaying summarized gaming information according to embodiments of the invention.

Referring to FIGS. 7A and 7B, a keno display screen 400A, 400B is shown with and without a map configuration. That is, a keno display may be initialized as a blank map 400A having 80 spaces 410 for which a player might predict will randomly be associated with a draw (e.g., a keno ball drawn, or an electronic number chosen by an RNG). As games progress, certain spaces may hit more than other spaces. These high hit spaces or squares may be considered "hot" or lucky by some players, while other players may look for spaces that have not hit often since they may be "due" to hit. Although numerical hit frequencies could be displayed for each space 210, shading or coloration of each space can quickly and elegantly display the gist of this information without causing undue confusion. The concept of this map shown in FIG. 7B is to quickly show "hot" areas of the game board and "cold" areas of the game board, and may be referred to as a "heat map" because of its association with areas of the game board that may be thought of as "hot" and "cold."

Additionally, the coloration or shading may cause random patterns, trends, or symbols to appear. For example, a player may see the pattern of a lucky symbol outlined in the map and decide that the game is a lucky game. Alternatively, the player may see a particular grouping that seems to appear frequently on the map display 400B. For example, if it seems that the hot squares are bunched in groups of three, a player may select several groups of three in the next game.

Within the map display 400B, different schemes of coloration or shading may be used to show the hit frequency of particular spaces or squares 410. For shading schemes, darker or more complex shading may indicate spaces that have a higher hit frequency than spaces having lighter or no shading. For coloration schemes, warmer colors such as yellows, oranges, and reds may be used to show spaces with a higher hit frequency, while cooler colors such as blues, indigos, and purples may be used to show spaces with a lower hit frequency. Neutral colors, such as green, may be used to show spaces or squares that are close to the predicted hit frequency associated with that space. These shading or coloration schemes may be determined in relation to a theoretical hit frequency for each space or a percentage of hits versus overall shown game events. The range for determining these hit frequencies may be predetermined by a casino or settable by a player, as discussed above.

In the embodiment shown in FIG. 7B, space 420 may have a higher hit frequency than space 430 and space 460, but not as high of a hit frequency as space 450 or 440. In coloration terms, space 430 may be a dark blue, space 460 may be light blue, space 420 may be green (neural) or yellow, space 450 may be orange, and space 440 may be red. Using this coloration scheme a player may determine that the numbers in the upper middle portion of the right side of the display 400B (number spaces 28-30 and 37-40) are doing particularly well, while numbers in the middle left portion (numbers 31-33, 41-43, and 51-52) are doing particularly poorly. When a player notes these perceived trends or patterns, it may influence the player on where they will select the next set of numbers of the game board.

Additional embodiments may include an option for the player that automatically identifies groupings of picks (such as lines, boxes, Ts, etc.) commonly used by a player and outlines possible grouping choices within the map along the lines of the identified groupings. The gaming device may use an algorithm to detect recent patterns in the groupings selected by the player and associate these detected patterns to "hot" areas of the map. Further, if the player is an identified player, the player or the gaming device may save preferred grouping formats used by the player so that future suggestions could be made for the player. If these preferences are set by the player, the player may choose a type of bet configuration (grouping) that they would like the gaming device to use in highlighting areas of the map.

The map concept works especially well with games that have a larger number of possible outcomes, such as keno or roulette (see FIGS. 8A and 8B below). It can also be effectively used in game performance displays that have many measured variables displayed, such as the blackjack game performance display illustrated in FIG. 6A. Even in circumstances where the map format may not be as helpful to a player, shading or coloration may be used to emphasize certain game performance statistics.

Figure 8A:
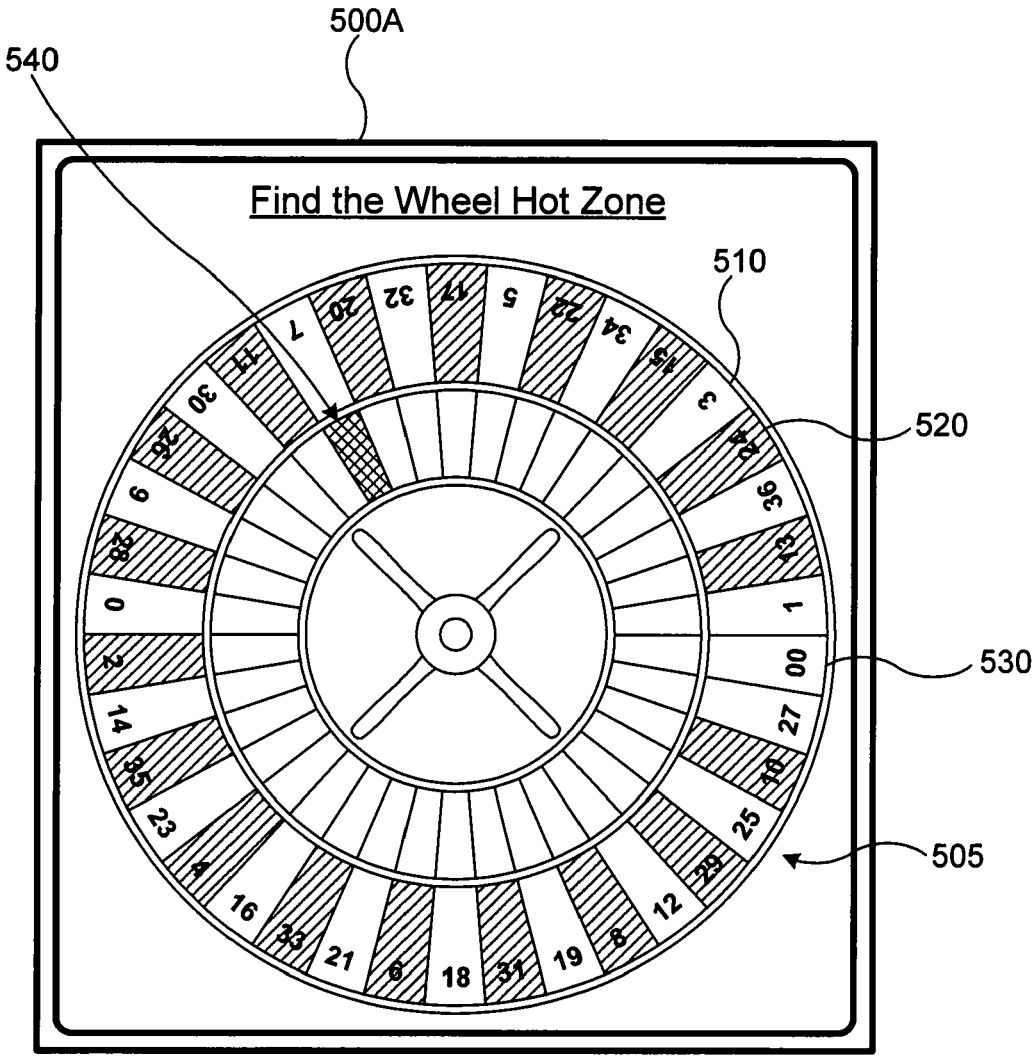
FIGS. 8A and 8B are detail diagrams of exemplary types of displays for displaying summarized gaming information according to embodiments of the invention.
Figure 8B:
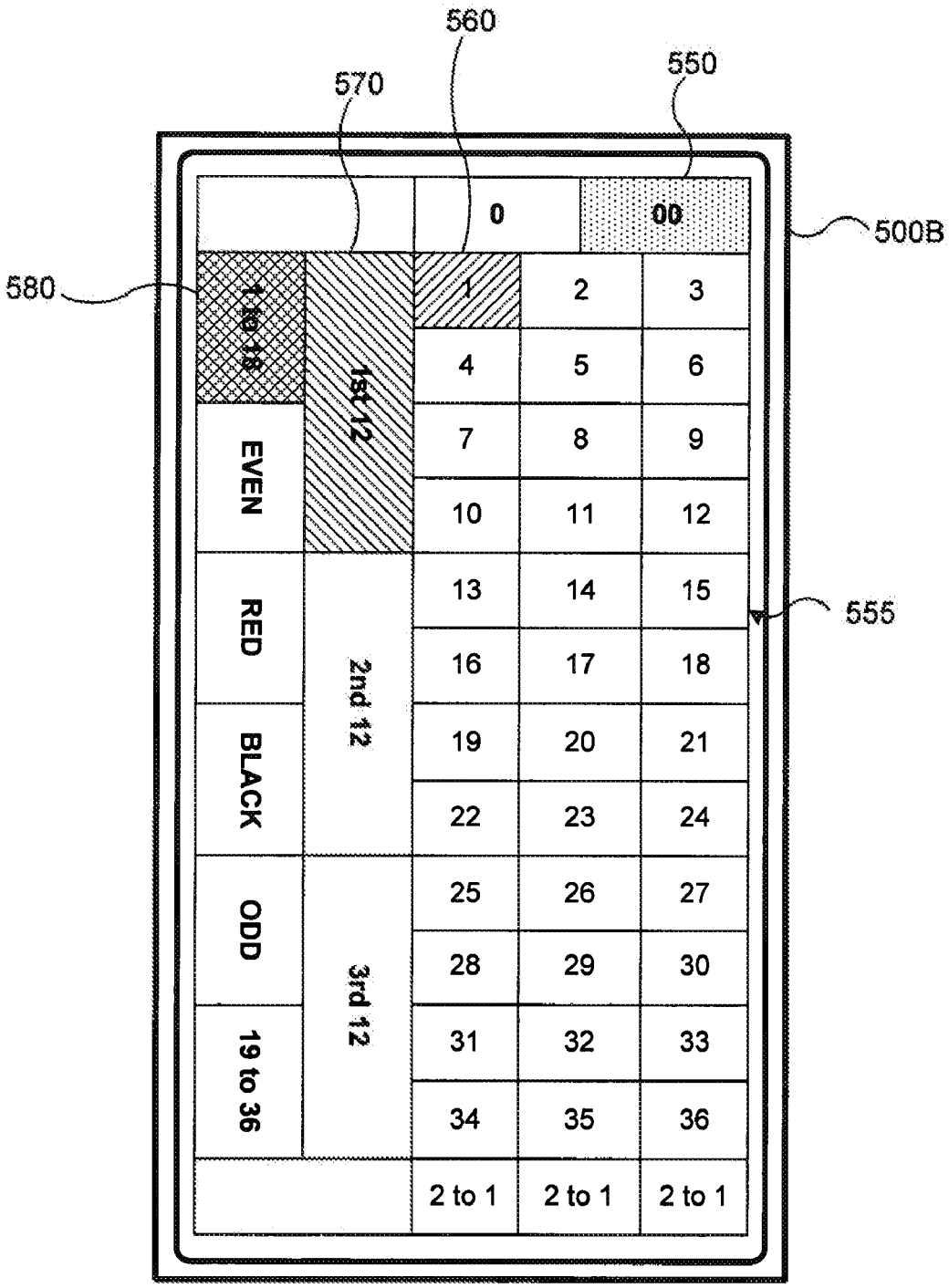

FIGS. 8A and 8B are detail diagrams of exemplary types of displays for displaying summarized gaming information according to embodiments of the invention.

Referring to FIGS. 8A and 8B, different types of displays 500A, 500B are shown for use with a roulette game. With many table games, such as roulette, a gaming device may be separated into a wagering portion and a gaming instrument portion. For example, in roulette, the marked table area showing the different wagering options may be the wagering portion and the roulette wheel itself may the gaming instrument portion. The wagering portion is where players place their wagers or bets, while the gaming instrument is utilized to complete a gaming event on the gaming device. Because the wagering portion may not necessarily look similar to the gaming instrument portion, a performance display for the gaming device may show a representation of the gaming instrument itself, such as the display of the roulette wheel 505 itself in the display 500A shown in FIG. 8A, or may show a representation of the wagering portion, such as the marked table 555 in the display 500B shown in FIG. 8B.

The displays 500A, 500B may be used interchangeably on a video monitor. That is, the display may periodically change between the two types of displays 500A, 500B. Alternatively, a casino operator may choose to show only one of the displays 500A, 500B. In other embodiments, both types of displays 500A and 500B may be shown at the same time on a common display or on individual displays. The choice between which of the displays 500A, 500B to use may be based on the portion of the game the casino is emphasizing.

For example, if the casino wants to focus on the hot portions of the wheel or individual numbers that are doing well, the display 500A of the wheel may be preferable. In this display 500A, wheel sections 540 associated with stops 510, 520, 530 on the wheel may be shaded or colored in a similar manner to the map discussed above with respect to 7B. That is warmer colors, such as yellows, oranges, and reds may be used to show numbers that have come up more often than theoretical statistics would predict. Similarly, cooler colors, such as purples and blues may be used to show numbers that have come up less often than theoretical statistics would predict. The colors of the red wheel stops 510, black wheel stops 520, and green wheel stops 530 may be shown on the display to accurately represent the physical roulette wheel. In this situation, inner or outer sections 540 corresponding to the wheel stops 510, 520, and 530 may be used to show the past performance of these numbers.

Alternatively, if the casino wants to focus on wagers that have been doing very well, or appear due for a win, the display 500B of the wagering portion of the table may be preferable. One advantage of this type of display, is that players can quickly assess how a particular type of wager has recently done at the gaming device that may be difficult to see from only a representation of the gaming instrument (roulette wheel) itself. For example, a wager on the first twelve number box ($1^{st}$ 12 box) 570 is readably apparent from the waging portion display 500B, but may be difficult to ascertain from just looking at a wheel display 500A. Individual number results 550, 560 may still be shaded, colored, or otherwise trend-identified on the wager portion display 500B. However, other possible wagers, such as the "$1^{st}$ 12" box 570 or the "1 to 18" box 580 may also be shaded, colored, or otherwise trend-identified to a player.

While FIGS. 8A and 8B show a "heat-map" style indication of how certain wagers or game results have recently been performing, these displays may use numerical displays, graphs, or other types of graphical depictions to alert players to recent trends on the gaming device. Each of these display types, while not necessarily shown in each illustrated embodiment, is contemplated by the present concept.

Figure 9A:
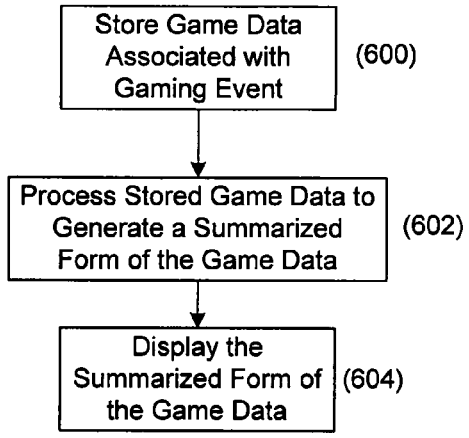
FIGS. 9A and 9B are flow diagrams illustrating methods of recording and processing game data according to embodiments of the invention.
Figure 9B:
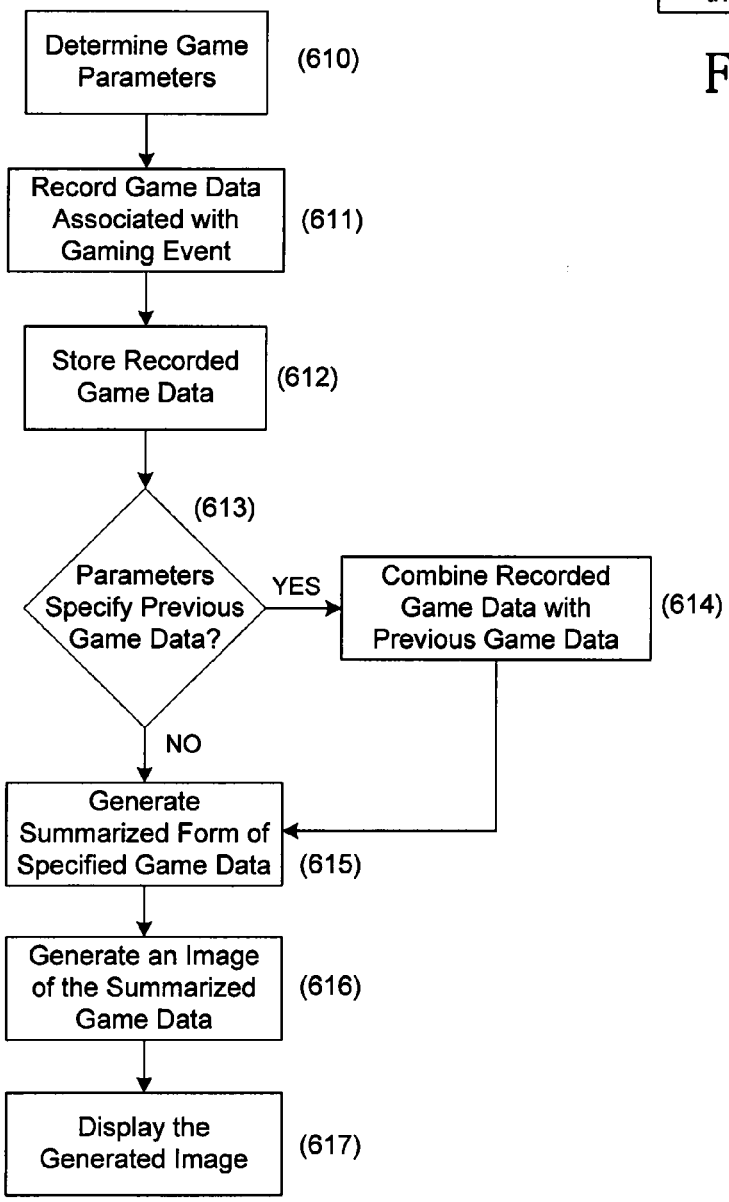

FIGS. 9A and 9B are flow diagrams illustrating methods of recording and processing game data according to embodiments of the invention.

Referring to FIG. 9A, a method of displaying historical game data to a player includes storing game data associated with a gaming event (600), processing the stored game data to generate a summarized form of the game data (602), and displaying the summarized form of the game data (604). The game data may be stored (600) as gaming events are taking place on the gaming device. Additional details about these processes are discussed below in the embodiments illustrated in FIGS. 9B through 15.

Referring to FIG. 9B, a method of displaying historical game data to a player includes determining parameters associated with a game (610), recording game data associated with gaming events occurring on the gaming device (611), and storing the recorded data (612). After the game data has been stored, the gaming device or system determines if the identified parameters have specified updating previously stored game data (613). If the parameters to indicate that the stored game data is to be used to update previous game data, the stored game data is combined with the previous game data (614). After this combination process, or if a combination of stored data with previous game data was not specified, a summarized form of the data specified by the game parameters is generated (615). An image of the summarized game data is then generated (616), and the generated image is displayed (617) on a game performance display.

When the game parameters are determined (610) the gaming device or gaming system may determine a type of visual output to display, a range of values to use in the display, whether a reset of the game information has been requested, and what player options to include with the display. The game data may be recorded for gaming events (611) in different manners depending on the type of gaming device. For example, for live-action table games card readers, cameras, pressure sensors, or other recording devices may be used to accurately and automatically record game data associated with gaming events. For electronic gaming machines or internet gaming, a processor may simply note the outcomes determined by the RNG.

The recorded game data may be stored (612) temporarily in dynamic or easily updated memory, such as cache memory, DRAM, or flash memories. Alternatively, the game data may be stored in a more permanent game memory including magnetic mediums, optical mediums, or flash memory. The recorded game data may be stored in local memory at the game device level temporarily or for as long as it exists. If it is stored temporarily, the contents of the local memory may be periodically transmitted to a remote server or other memory database for archival purposes. The local memory may also be erased and cleaned after this periodic transmittal.

New game data may be combined (614) with previous game data prior to a summarization of the game data to display so as to easily run calculations using the new game data. For example, where the game parameters track hit frequency of 4 of a kinds over 828 hands, a new game result may be combined with the previous 827 hands before a summarized form of this data is generated.

When a summarized form of the game data is generated (615), the gaming device or system may perform calculations to condense the raw stored game data into a summarized form that conveys the nature of the data to a player without being overly cumbersome or confusing. For example if the average payback is to be calculated for the past 10 games on a dollar wager, and the amounts won in the previous 10 games are shown below in Table 1, the average payback is simply the sum of the amounts won divided by the amount wagered.

TABLE 1

| | Game No. | | | | | | | | | | |
|---|---|---|---|---|---|---|---|---|---|---|---|
| | 1 | 2 | 3 | 4 | 5 | 6 | 7 | 8 | 9 | 10 | Total |
| Wager | $1.00 | $1.00 | $1.00 | $1.00 | $1.00 | $1.00 | $1.00 | $1.00 | $1.00 | $1.00 | $10.00 |
| Win | $0.00 | $0.75 | $5.00 | $0.00 | $0.00 | $0.25 | $0.50 | $1.00 | $2.00 | $0.00 | $ 9.50 |

In this example, the calculation used to generate the summarized game date would include adding the amounts won in the past 10 games ($9.50), adding the amounts wagered in the past 10 games ($10.00), and dividing the amounts won by the amounts wagered, which is 95% in this example. When a new gaming event is played, the last game (game No. 10) may be removed, all of the other games may be shifted to the right by one space and the result of the new gaming event may be added to the Game No. 1 position. If the player wins $1.00 in the new gaming event, the payback percentage for the gaming device may be changed to 105% payback.

An image of the summarized data (616) may be generated according to the type and range of the display specified by the game parameters. If the display is simply a numerical output, the new summarized number may simply be formatted for display. If the display is a graph such as the one shown in the embodiment illustrated in FIG. 5B, the measurement line 285 may be altered to reflect the addition of the new game data. The generated image is then displayed (617) on the game performance display associated with the gaming device.

Figure 10:
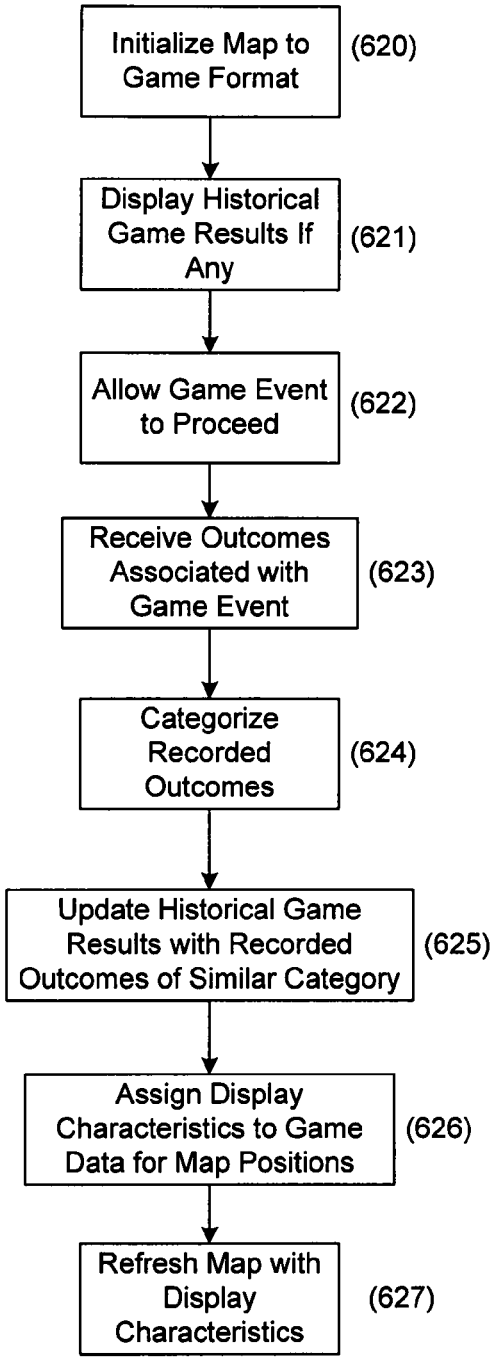
FIG. 10 is a flow diagram illustrating methods of displaying a map showing summarized gaming information according to embodiments of the invention.

FIG. 10 is a flow diagram illustrating methods of displaying a map showing summarized gaming information according to embodiments of the invention.

Referring to FIG. 10, a map is initialized to match a game format (620) specified by set game parameters. This initialization process may not need to be repeated between all game events. However, it may be preferably performed when there is a player change, position change, dealer change, shoe change, or other game change that requires the old data to be less relevant. Additionally, only a portion of the map may need to be initialized depending on the parameters and circumstances. Historical game results are displayed on the map (621) if specified by the game parameters. This display of historical results may be in the form of maintaining color or shade characteristics for certain aspects of the map.

A game event is then allowed to proceed (622) and outcomes associated with the game event are received (623). These outcomes may be the ultimate result of a gaming event or an intermediate step within a gaming device. For example, if a display was specified to show the number of natural 20-point or higher draws occurring on the first two cards in a blackjack game, the result of the originally dealt cards may be received prior to the ultimate outcome of the blackjack game after the dealer's cards are shown. Once the game outcomes are received, the gaming device or system categorizes the recorded outcomes (624). They may be categorized by the object it is assigned to, e.g., the player, dealer, shoe, device, etc. Alternatively or in addition, the outcomes may be categorized by the type of outcome it is, e.g., is it a blackjack, a 20-point hand, or another type of dealt hand.

The historical game results may be updated with recorded outcomes in similar categories (625). For example, if a natural blackjack was received, the blackjack hit frequency category may be updated to reflect the new outcome. A display characteristic is then assigned to the updated game data for the map positions (626). Here, the proper color or shade may be determined for any map position affected by the addition of the new game data. Since game data is often measured over discreet time or game intervals, even when a new game result is just a loss, the display characteristic of each map position may be altered to "cool down" the map colors. The map is then refreshed with the newly assigned display characteristics (627) and shown to the player.

Figure 11:
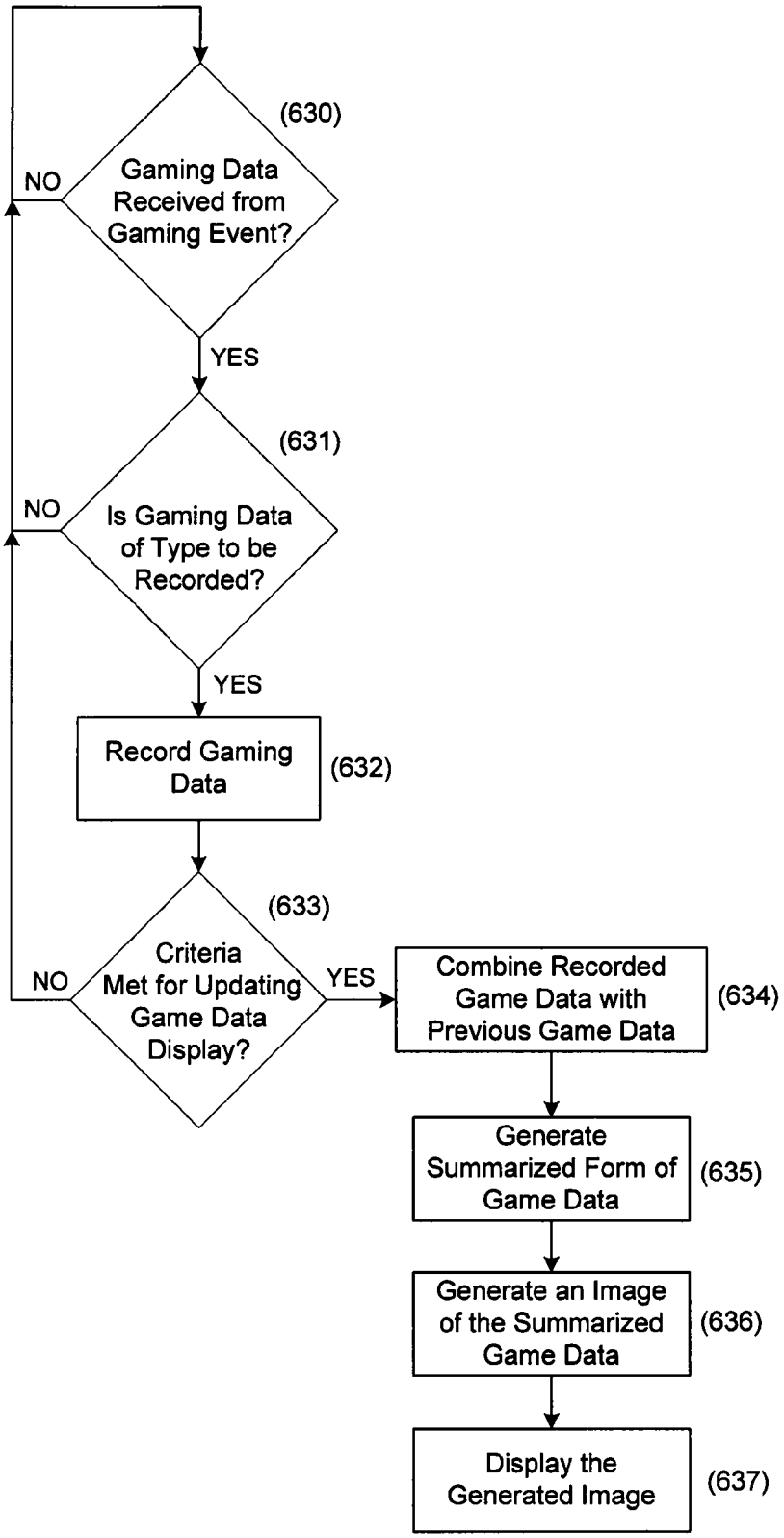
FIG. 11 is a flow diagram illustrating methods of updating a display showing summarized gaming information according to embodiments of the invention.

FIG. 11 is a flow diagram illustrating methods of updating a display showing summarized gaming information according to embodiments of the invention.

Referring to FIG. 11, this embodiment of a method of updating a game performance display includes waiting for game data to be received from a gaming event (630). When game data is received, the gaming device or gaming system determines if the gaming data is of the type to be recorded (631). That is, the gaming device or gaming system may not record all game data received about played gaming events. For example, if a video poker machine only measures the hit frequency of 4 of a kinds and royal flushes, the machine may disregard other game event outcomes and simply keep a separate game count by which it may determine the desired hit frequency statistics. Although memory has become relatively cheap, there is still some cost and time savings in not recording outcomes and other game data that are not going to be utilized in the game performance display. Hence, making this determination may be advantageous for any embodiment of the present concept. When one type of data is currently selected to be shown on a game performance display, it may still be preferable to record other game data that could later be requested to be displayed on the game performance display.

Returning to FIG. 11, if the gaming data is determined to be of the type to be recorded (631), the gaming data is recorded (632) using one of the recording methods described above. It is next determined whether a criteria has been met for updating game performance display with the game data (633). That is, it may be unnecessary to update certain types of game data displays with each record or stored game data instance. For example, if a line graph (such as the one illustrated in FIG. 4) represents a games overall hit frequency or payback, it may be preferable to only update the graph trend line every five games. This way short streaks of wins/losses or large win amounts do not skew the data on the graphs as much. By not constantly updating the display, the gaming device may also save small amounts of processing speed. With some types of game performance displays, each recorded data point should require the updating of the display, such as a chart count of a certain game event outcome.

When the criteria for updating the game display are met, the recorded game data is combined with previously stored game data (634). A summarized form of the combined game data is then generated (635) as described in the embodiments above. An image of the summarized game data is then generated (636), and displayed on the game performance display (637).

Figure 12:
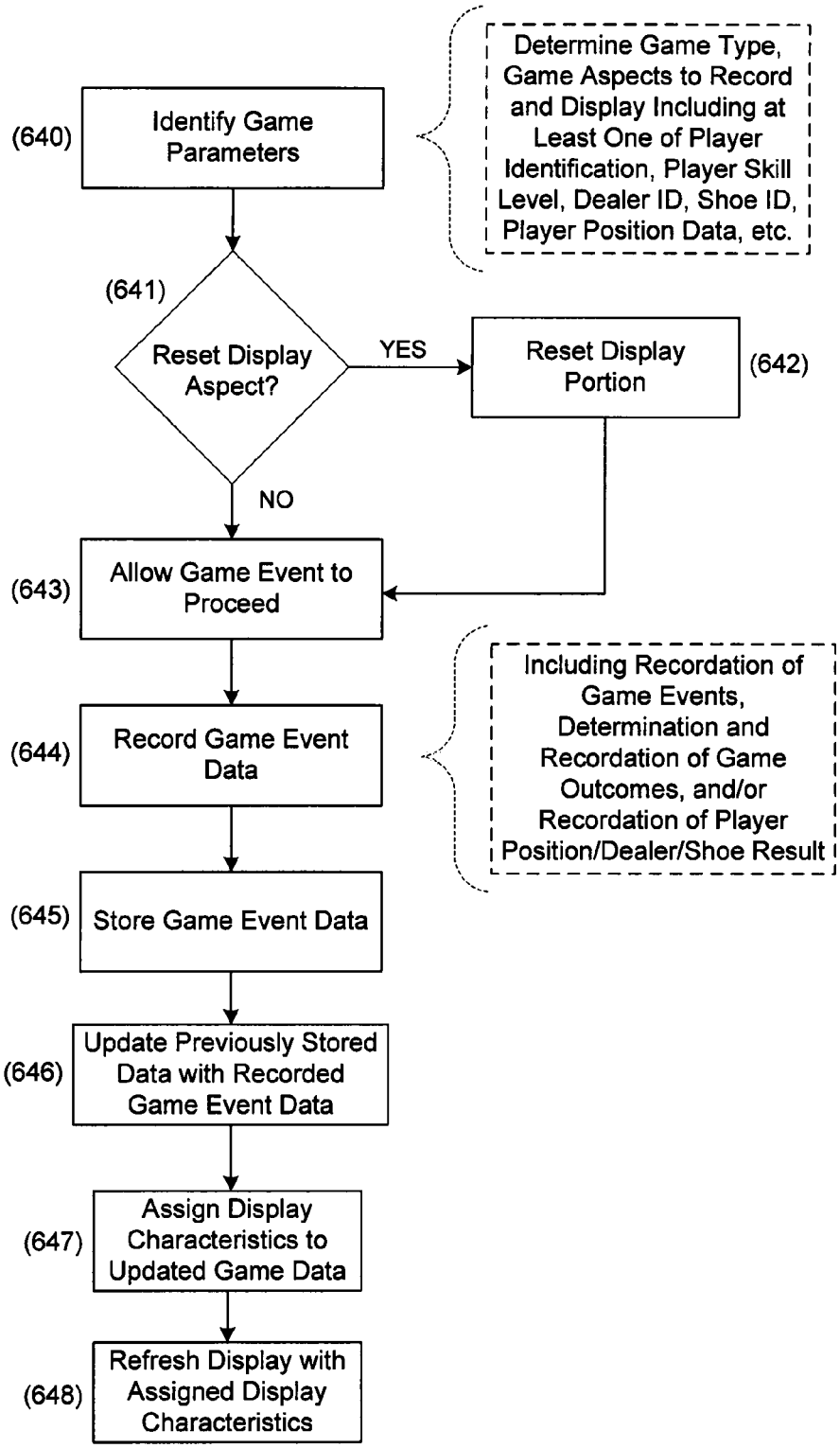
FIG. 12 is a flow diagram illustrating methods of displaying summarized gaming information according to embodiments of the invention.

FIG. 12 is a flow diagram illustrating methods of displaying summarized gaming information according to embodiments of the invention.

Referring to FIG. 12, the method of displaying summarized gaming information is similar to the one shown in FIG. 9B in many aspects. Thus, substantially identical processes within the method will not be repeated in detail. In the present embodiment, the game parameters of the gaming device or gaming system are identified (640). This process may include determining the game type, the range of game data to be used in the game display, and the game data that is to be recorded and displayed including at least one of a player identification, a player skill level, a dealer identification, a shoe identification, and gaming station position identification. The gaming device then determines whether any display aspect needs to be reset (641), and resets those aspects that are determined to be reset (642). For example, if a new dealer has rotated to the gaming device, the portion of the gaming performance display related to the dealer may be reset to either a neutral indicator or color, or the dealer display portion may be reset with past game data associated with the new dealer. Similarly, if a new shoe of cards is being used, or a new set of dice is being used, a corresponding display portion may be reset to a neutral performance indication.

A game event is then allowed to proceed on the gaming device (643), and game information or data is recorded for the game event (644). This recordation may include the determination and recordation of game outcomes and/or the recordation of specific results related to a gaming position, a dealer, or a shoe. For some table games, this determination of game outcome may include both a comparison of player's hand to dealer's or banker's hand (e.g., in blackjack, pai gow, pai gow poker, 3 card poker, baccarat, etc.), as well as a measurement of the player's skill in making game decisions. For example, in blackjack a player may "stay" on a hand totaling twelve when the dealer is showing a ten point card. The dealer may end up busting, thereby making the player a winner. But a player skill determination algorithm may determine that the player's play was not theoretically a good play. Thus, while the identified player, gaming position associated with the player, dealer, and shoe performance indicators may improve with this result, the player's skill level indicator may decline.

After the game data is recorded, the game data is stored (645) either locally at the gaming device or remotely in a database or server. Previously stored game information may be then be combined and updated with the newly stored game data (646). This updated data may then have a display characteristic assigned to it (647), such as a shade or coloration update being assigned to associated display portions of the game performance display. These display portions are then refreshed with the assigned display characteristics (648).

Figure 13:
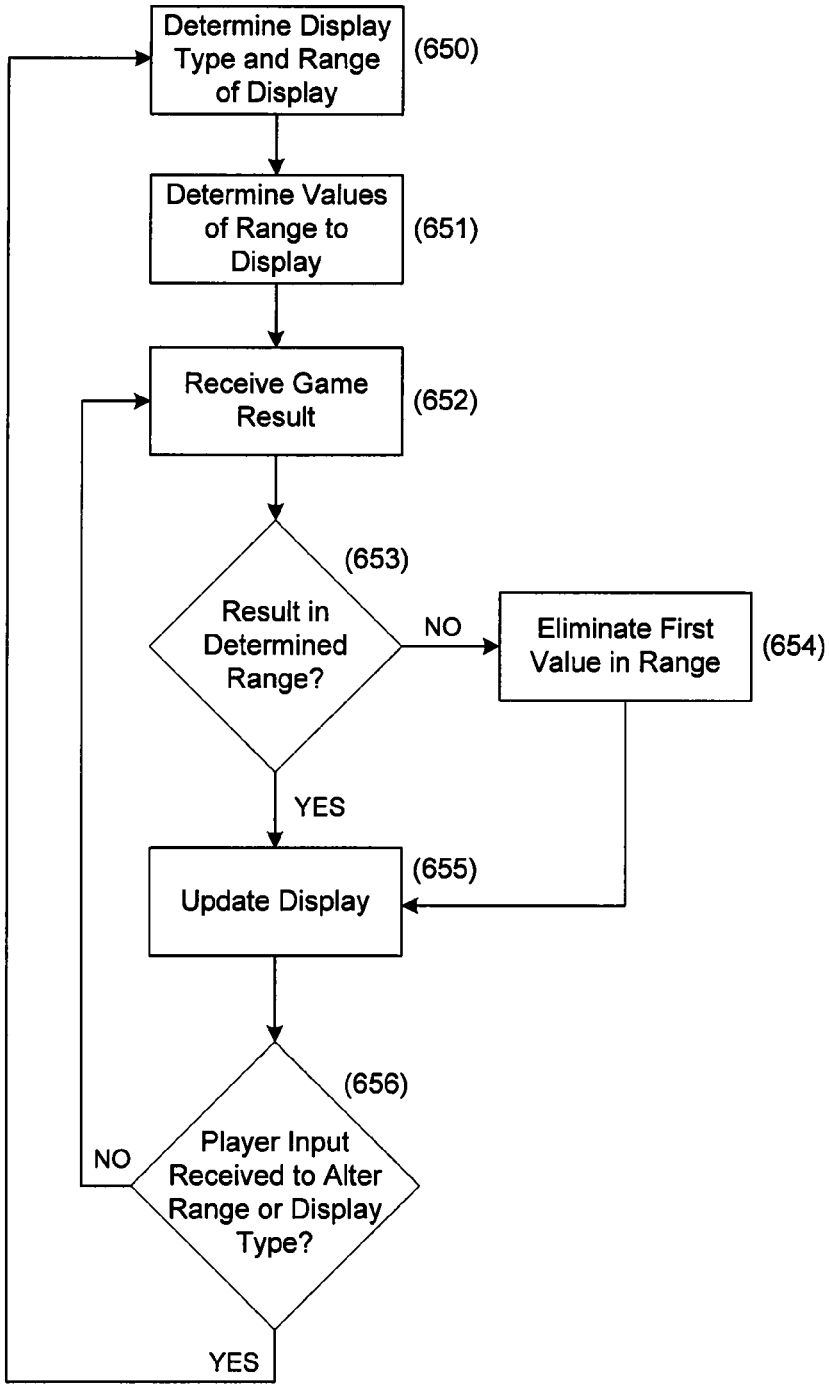
FIG. 13 is a flow diagram illustrating methods of displaying summarized gaming information according to embodiments of the invention.

FIG. 13 is a flow diagram illustrating methods of displaying summarized gaming information according to embodiments of the invention.

Referring to FIG. 13, a method of adjusting the game data displayed in a game performance display includes determining a display type and range/scale of the data to be displayed (650). For example, a line graph for the hit frequency of the last 100 games may be requested. The values of the range of the display may then be determined (651). In the above example, if the current gaming session is on the $650^{th}$ game, the range values of the display may be determined to be game 551 through game 650.

After a game outcome or result is received (652), the $651^{st}$ game in the above example, the gaming device or gaming system may determine if the game result is within the determined range (653). In the ongoing example, game event 651 is outside the range of game events 551 to 650. However, if the game event was only the $85^{th}$ game in a gaming session, the game result would still be in the range of the games 1 through 100. If the game result is determined to be outside the range, a first value in the range is eliminated (654). In the first example, the result associated with the $550^{th}$ game would be eliminated to make room for the new game result of the $651^{st}$ game.

The game display is then updated with the result of the new gaming event (655). Additional intermediate processes may be present to combine and summarize the game date as previously discussed. In the first example, the display would be updated to show the hit frequency of the $552^{nd}$ through $651^{st}$ gaming events (i.e., the hit frequency for the previous 100 games). In the second example, the updated display would only show the hit frequency for the $1^{st}$ through $85^{th}$ game. This process allows players to reset displays and track their hit frequency as they play additional gaming events within their gaming session.

The gaming device or gaming system then determines if a player input has been received to alter the range or type of display (656). When no player input is received, the game simply waits for the next game result to be received (652). However, when a player directs the gaming device or gaming system to change the display of the game performance data, the entire process may be repeated starting with the determination of the display type and range of the display (650). In the first discussed example, if the player decides he or she wants to see the historical hit frequency over the last 200 games instead of the last 100 games, the range of the display may be re-determined (650) and a new range of values for the display may be determined (such as the display of the hit frequency for games 452 through 651).

Figure 14:
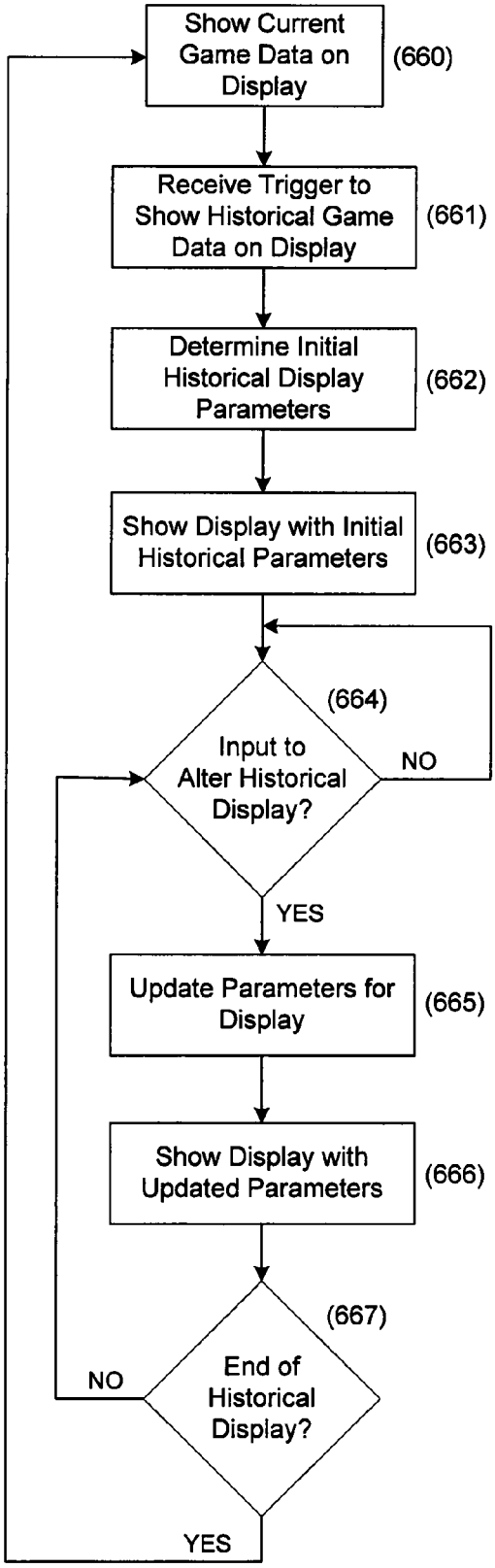
FIG. 14 is a flow diagram illustrating methods of altering a display of summarized gaming information according to embodiments of the invention.

FIG. 14 is a flow diagram illustrating methods of altering a display of summarized gaming information according to embodiments of the invention.

Referring to FIG. 14, the method of altering a display of summarized gaming information to show additional historical game data includes showing the current game data on the game performance display (660) and receiving a trigger to show historical game data on the game display (661). Unlike the previous embodiment shown in FIG. 13, the player may choose to review the hit frequency for previous 100 game intervals rather than alter the range of the display itself. In the first example used above for FIG. 13, the player wishes to review the hit frequency trend per 100 games for all of the game events played thus far. Here, the initial historical display parameters are first determined (662). In the example, the initial historical display parameters may be the hit frequency for game 1 through game 100.

Once these historical display parameters are determined (662), the display may be updated to show the historical game data with these determined parameters (663). The game device or game system may then determine if an input is received to alter the historical display (664). This input may be in the form of a player pressing a button or otherwise manipulating the display to scroll through the historical game data. Alternatively, the gaming device may automatically scroll through the historical data by periodically sending a triggering signal to alter the historical display. The player may also exit the historical view of the game data to return to a current display of game data.

When this input is received, the parameters for the display are updated (665). In the above example, the device is instructed to automatically scroll through the entire range of historical data. In this example, a trigger is received every $10^{th}$ of a second to move the display forward by one game interval. Thus, a trigger is received after the first $10^{th}$ of a second (0.1 seconds) and the parameters for the historical display are changed to display the hit frequency of games 2 through 101. After these parameters are determined (665), the display itself is updated and shown with the game data associated with the newly determined parameters (666). The game device or system then determines if the end of the historical display has been reached (667). In the ongoing example, the automatically scrolling historical display continues until the current game display is reached (i.e., the hit frequency display of games 552 through 651), or the player otherwise ends the historical display.

Figure 15:
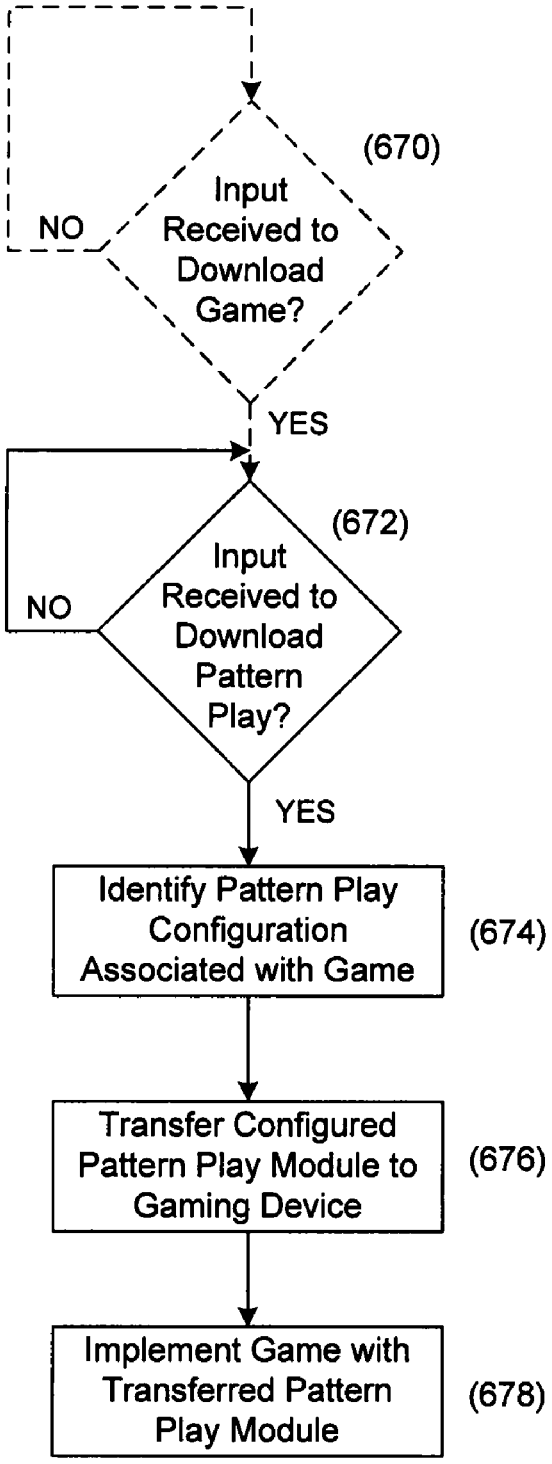
FIG. 15 is a flow diagram illustrating methods of downloading a pattern play module associated with a game performance display according to embodiments of the invention.

FIG. 15 is a flow diagram illustrating methods of downloading a pattern play module associated with a game performance display according to embodiments of the invention.

Referring to FIG. 15, the method includes determining whether an input has been received to download a pattern play module (672), which may include a module that can be implemented on a gaming device 70-75 (FIG. 3) to show game performance information. For embodiments that utilize server based gaming or otherwise use a remote server 80 to facilitate or implement game play, the method may also wait for a received input to download a game (670) or an aspect of a game. When an input is received to download the pattern play module (672), a configuration for the pattern play module associated with the gaming is identified (674). For example, a default type of game performance display (in the pattern play module) may be associated with a video poker game that is different than a default type of game performance display associated with a slot machine. In addition, if an identified player has a display-type preference associated with their player loyalty number, that type of display may be identified at this time.

After the pattern play configuration has been identified (674), the configured pattern play module is transferred to the gaming device (676). Here, the network 50 (FIG. 3) may be used to transfer the pattern play module to a gaming device 70-75 from the server 80. After the configured pattern play module has been transferred (676) to the gaming device, the transferred pattern play module is implemented on the gaming device to work with the associated game. As discussed above, remotely saved pattern play modules may be associated with a particular gaming device, with a particular type of game, with an identified player, etc.

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out in the appended claims.

The invention claimed is:

1. A gaming device comprising:

a player gaming station to allow a player to place a wager on a gaming event;

a recorder configured to record game information corresponding to the gaming event;

a memory configured to store the recorded game information;

a processor configured to summarize the stored game information and generate signals corresponding to a visual depiction of the summarized game information;

a performance display configured to display the visual depiction of the summarized game information to the player, wherein the performance display is configured to compare the summarized game information with a base line metric associated with the summarized game information, and a player input device configured to alter the visual depiction of the summarized game information displayed on the performance display.

2. The gaming device of claim 1, wherein the performance display is a portion of a game display, the game display configured to display a result of the gaming event.

3. The gaming device of claim 1, further comprising a game display separate from the performance display, the game display configured to display a result of the gaming event.

4. The gaming device of claim 1, wherein the player input device is configured to alter the type of summarized game information displayed on the performance display.

5. The gaming device of claim 4, wherein the player input device is configured to allow the player to alter the range of summarized game data displayed on the performance display.

6. The gaming device of claim 1, wherein the gaming device includes a plurality of player gaming stations.

7. The gaming device of claim 6, wherein each of the plurality of player gaming stations includes an individual performance display.

8. The gaming device of claim 7, wherein each of the individual performance displays is configured to display summarized game information associated with other ones of the plurality of game stations.

9. The gaming device of claim 6, wherein the performance display is a common display for the plurality of player gaming stations, the common performance display configured to display summarized game information associated with the plurality of player gaming stations.

10. The gaming device of claim 9, wherein the gaining device is a live action table game.

11. The gaming device of claim 10, wherein the performance display includes a visual representation of a layout of the table game.

12. The gaming device of claim 11, wherein the performance display includes an avatar associated with at least one of the player gaming stations.

13. The gaming device of claim 10, wherein the recorder includes a card reading device.

14. The gaming device of claim 10, wherein the recorder includes a camera system having a recognition software program.

15. The gaming device of claim 1, wherein the performance display includes a graphical representation of the summarized game information.

16. The gaming device of claim 1, wherein the performance display includes at least one numerical display associated with the summarized game information.

17. The gaming device of claim 1, wherein the performance display includes a map element that changes shades or colors in response to the summarized game information.

18. The gaming device of claim 17, wherein the map element corresponds to possible outcomes associated with the gaming event.

19. The gaming device of claim 1, wherein the processor is further configured to identify predetermined outcomes and wherein the performance display is further configured to display the predetermined outcomes on the visual depiction of the summarized game information.

20. A gaming system comprising:

at least one gaming device having at least one player gaming station to allow a player to place a wager on a gaming event, the gaming device including a recorder configured to record game information corresponding to the gaming event and associate the recorded game information with the player;

a server connected to the gaming device through a network, the server including:

a receiver configured to receive the recorded game information from the gaming device, a memory to store the recorded game information associated with the player, and a processor configured to summarized the stored game information associated with the player and to generate signals corresponding to a visual depiction of the summarized game information; and a display visible to the player at the gaming device, the display configured to display the visual depiction of the summarized game information to the player, wherein the display is further configured to compare the summarized game information with a base line metric associated with the summarized game information.

21. The gaming system of claim 20, wherein the gaming device is one of a plurality of gaming devices arranged in a bank of gaming devices, the display being a common display for the bank of gaming devices.

22. The gaining system of claim 21, wherein the display is configured to show summarized game information for the bank of gaming devices.

23. The gaming system of claim 20, further including a remote display configured to show a representation of summarized game information shown on the display.

24. The gaming system of claim 23, wherein the remote display is a wireless mobile device.

* * * * *

UNITED STATES PATENT AND TRADEMARK OFFICE

CERTIFICATE OF CORRECTION

PATENT NO. : 8,182,326 B2
APPLICATION NO. : 12/398889
DATED : May 22, 2012
INVENTOR(S) : L. Donald Speer, II et al.

It is certified that error appears in the above-identified patent and that said Letters Patent is hereby corrected as shown below:

Column 29, line 24 (Claim 10): Delete "gaining" and insert --gaming--, therefor.

Column 30, line 36 (Claim 22): Delete "gaining" and insert --gaming--, therefor.

Signed and Sealed this
Eighteenth Day of December, 2012

David J. Kappos

David J. Kappos
*Director of the United States Patent and Trademark Office*